US005967768A

United States Patent [19]

Saito et al.

[11] Patent Number: 5,967,768

[45] Date of Patent: Oct. 19, 1999

[54] LIGHTING DEVICE

[75] Inventors: Masaki Saito; Toshihiro Ichikawa, both of Shizuoka-ken, Japan

[73] Assignee: Tokai Corporation, Tokyo, Japan

[21] Appl. No.: 09/138,050

[22] Filed: Aug. 21, 1998

[30] Foreign Application Priority Data

| | | | |
|---|---|---|---|
| Aug. 22, 1997 | [JP] | Japan | 9-226214 |
| Aug. 22, 1997 | [JP] | Japan | 9-226215 |
| Jan. 26, 1998 | [JP] | Japan | 10-012619 |

[51] Int. Cl.[6] ..... F23D 11/36

[52] U.S. Cl. ..... 431/153; 431/255

[58] Field of Search ..... 431/153, 255

[56] References Cited

U.S. PATENT DOCUMENTS

| | | | |
|---|---|---|---|
| 5,326,256 | 7/1994 | Shike et al. | 431/255 |
| 5,697,775 | 12/1997 | Saito et al. | 431/153 |

*Primary Examiner*—Carroll Dority
*Attorney, Agent, or Firm*—Baker & Botts, LLP

[57] ABSTRACT

A lighting device comprises a valve mechanism for opening and closing a path, through which a gas is supplied from a gas tank to a jetting nozzle, a piezo-electric unit for generating a discharge voltage for lighting the gas, and an operation member, which can slide and drives the valve mechanism and the piezo-electric unit in order to carry out a lighting operation. A locking member capable of moving between a position for locking and a position for lock release works such that, when the locking member is set at the position for the locking, the locking member may lock the lighting operation of the operation member, and such that, when the locking member is set at the position for the lock release, the locking member may allow a single lighting operation of the operation member. A restraining member allows successive lighting operations of the operation member when the locking member is moved to the position for the lock release.

13 Claims, 27 Drawing Sheets

FIG. 23A
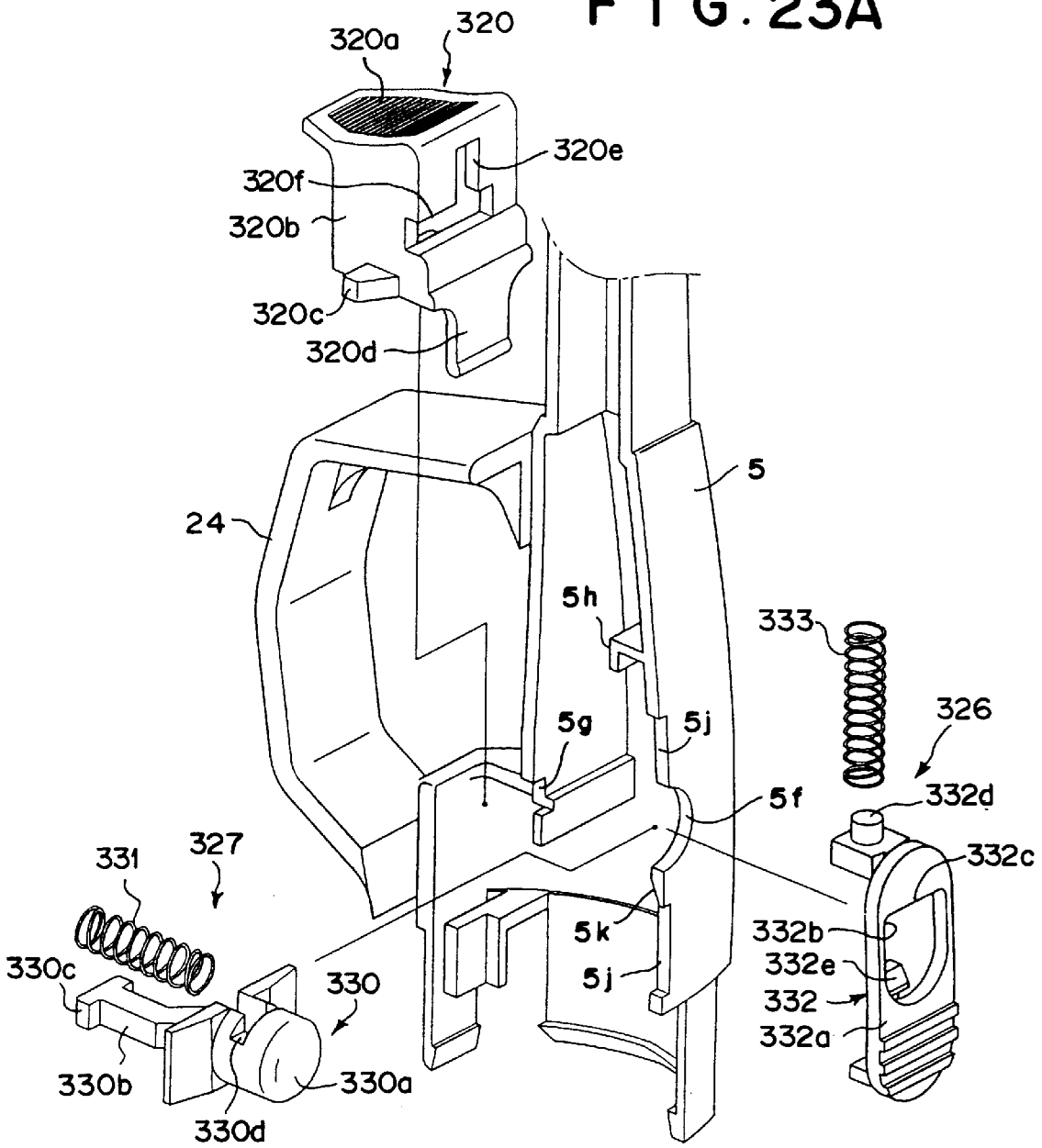
FIG. 23B
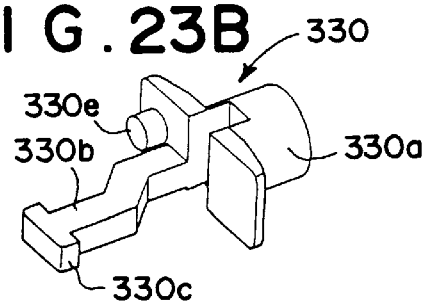
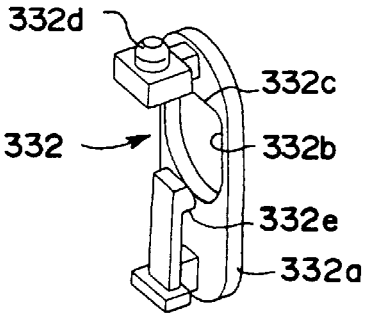
FIG. 23C

LIGHTING DEVICE

BACKGROUND OF THE INVENTION

1. Field of the Invention

This invention relates to a lighting device, in which a flame is produced and jetted from a jetting nozzle with an operation of an operation member, wherein the lighting operation of the operation member is locked when the lighting device is not used, and wherein the lock is released and a single lighting operation or successive lighting operations are enabled when the lighting device is used.

2. Description of the Prior Art

Structures for lighting devices, such as lighters and lighting rods, which are provided with lighting control functions, have heretofore been proposed in, for example, U.S. Pat. No. 5,458,482. In the proposed structures, a locking member is provided for locking the operation of an operation member, which carries out a lighting operation. When the locking member is not operated, it is kept in the state of the locking of the lighting operation of the operation member. When a lock releasing operation of the locking member is carried out, the lighting operation becomes possible. Also, in association with the lighting operation, the locking member is automatically returned to the state of the locking.

However, with the lighting devices described above, the lock releasing operation of the locking member must be carried out each time a single lighting operation has been carried out. Therefore, in cases where a fire could not be lighted with a single lighting operation, the lock releasing operation of the locking member must firstly be carried out, and a lighting operation must then be carried out. Thus the re-lighting operation cannot be kept simple.

Accordingly, it is desired to obtain both of a function with which, in cases where a lighting device is stored after the lighting operation has been finished, the state of the locking of the lighting operation is set automatically and the lighting is restrained reliably unless the lock releasing operation of a locking member is carried out, and a function with which, at the time of the lighting operation, in cases where a fire could not be lighted occasionally with the lighting operation, successive lighting operations can be carried out without the lock releasing operation of the locking member being carried out after each lighting operation is carried out.

SUMMARY OF THE INVENTION

The primary object of the present invention is to provide a lighting device, which automatically returns to a lighting operation restraining state in a non-use state and allows successive lighting operations to be carried out easily.

The present invention provides a first lighting device, comprising:

i) a jetting nozzle for jetting out a gas, ii) a gas tank, iii) a valve mechanism for opening and closing a path, through which the gas is supplied from the gas tank to the jetting nozzle, iv) a piezo-electric unit for generating a discharge voltage for lighting the gas, and v) an operation member, which is capable of sliding and drives the valve mechanism and the piezo-electric electric unit in order to carry out a lighting operation, wherein the improvement comprises the provision of:

a) a locking means, which is capable of moving between a position for locking and a position for lock release, the locking means working such that, when the locking means is set at the position for the locking, the locking means may lock the lighting operation of the operation member, and such that, when the locking means is set at the position for the lock release, the locking means may allow a single lighting operation of the operation member, and b) a restraining means, which allows successive lighting operations of the operation member when the locking means is moved to the position for the lock release.

In the first lighting device in accordance with the present invention, the locking means should preferably work such that, when the locking means is set at the position for the lock release, the locking means may allow the lighting operation of the operation member, and such that the locking means may automatically return to the position for the locking, accompanying the lighting operation of the operation member.

Also, the lighting device in accordance with the present invention should preferably be provided with a retaining means, which retains the locking means at the position for the lock release, and a retention releasing means, which releases the locking means from the retention by the retaining means, the releasing being carried out in association with the lighting operation. In such cases, the restraining means should preferably work such that, when the restraining means is set at an un-restraining position in a non-working state, the restraining means may allow the returning movement of the locking means, which has been released by the retention releasing means, to the position for the locking, such that, when the restraining means is set at a restraining position in a working state, the restraining means may cause the returning movement of the locking means, which has been released by the retention releasing means, to the position for the locking to be obstructed at an intermediate point of the returning movement, and such that, when the restraining means is set from the restraining position to the un-restraining position, the restraining means may cause the locking means to move from the intermediate point of the returning movement to the position for the locking.

The present invention also provides a second lighting device, comprising:

i) a jetting nozzle for jetting out a gas, ii) a gas tank, iii) a valve mechanism for opening and closing a path, through which the gas is supplied from the gas tank to the jetting nozzle, iv) a piezo-electric unit for generating a discharge voltage for lighting the gas, and v) an operation member, which is capable of sliding and drives the valve mechanism and the piezo-electric unit in order to carry out a lighting operation, wherein the improvement comprises the provision of:

a) a locking means, which locks the operation member and is located at an outer surface of the lighting device, and b) a restraining means, which restrains the locking means and is located at the outer surface of the lighting device, the restraining means working such that, when the restraining means is set from a restraining position to an un-restraining position, the restraining means may enable the locking means to undergo a lock releasing operation by being set from a position for the locking to a position for the lock release and may allow the lighting operation of the operation member.

In the second lighting device in accordance with the present invention, the locking means should preferably work such that, when the lock releasing operation of the locking means is continued, repeated lighting operations of the operation member may be capable of being carried out.

Also, the restraining means may work such that it may automatically return from the un-restraining position to the restraining position. In such cases, the restraining means may work such that the returning movement from the un-restraining position to the restraining position may be obstructed at an intermediate point of the returning movement, and such that, when the locking means is set from the position for the lock release to the position for the locking, the restraining means may return from the intermediate point of the returning movement to the restraining position.

For example, the second lighting device in accordance with the present invention may be provided with a retaining means, which retains the restraining means at the un-restraining position, and a retention releasing means, which releases the restraining means from the retention by the retaining means, the releasing being carried out in association with the lighting operation of the operation member. Alternatively, the second lighting device in accordance with the present invention may be provided with a retaining means, which retains the restraining means at the un-restraining position, and a retention releasing means, which releases the restraining means from the retention by the retaining means, the releasing being carried out in association with the lock releasing operation of the locking means.

Specifically, the second lighting device in accordance with the present invention may be provided with:

a locking member, which interferes with a portion of the operation member and locks the lighting operation, a first resilient means, which urges the locking member toward the position for the locking, a restraining member, which works such that, when the restraining member is set at the restraining position, the restraining member may restrain a movement of the locking member toward the position for the lock release, and such that, when the restraining member is set at the un-restraining position, the restraining member may allow the movement of the locking member toward the position for the lock release, and a second resilient means, which urges the restraining member toward the restraining position, the locking member being moved to the position for the lock release against the urging force of the first resilient means after the restraining member has been moved from the restraining position to the un-restraining position.

Also, in the second lighting device in accordance with the present invention, the locking means may be constituted of a working member, which is capable of being operated from the exterior, and a locking member, which obstructs the operation of the operation member, the locking member being moved by the working member from the position for the locking to the position for the lock release.

Further, in the second lighting device in accordance with the present invention, the restraining means may work such that the restraining means may be retained at the un-restraining position by resilient force of the restraining means itself, such that the restraining means may be moved, accompanying the movement of the locking means, and may thereby be released from the retention at the un-restraining position, and such that the restraining means may return to the restraining position by the resilient force of the restraining means itself.

With the first lighting device in accordance with the present invention, in cases where the locking means is not moved to the position for the lock release and is set at the position for the locking, the lighting operation of the operation member cannot be carried out and is locked. When the locking means is moved to the position for the lock release, a single lighting operation of the operation member can be carried out. After the lighting operation has been carried out, the locking member can automatically return to the state of the locking of the lighting operation. Also, when the locking means is moved to the position for the lock release and the restraining means is moved to the restraining position, successive lighting operations of the operation member can be carried out. When the restraining means is returned to the un-restraining position, the locking member automatically returns to the state of the locking of the lighting operation. In this manner, appropriate lighting control functions can be obtained.

Further, with the first lighting device in accordance with the present invention, wherein successive lighting operations of the operation member can be carried out by operating the restraining means, in cases where a fire could not be lighted with a single lighting operation, a re-lighting operation can be carried out easily. Thus the first lighting device in accordance with the present invention has good operability. Furthermore, the returning to the state of the locking of the lighting operation can be carried out accompanying the movement of the restraining means to the un-restraining position.

With the second lighting device in accordance with the present invention, in cases where the restraining means is not moved to the un-restraining position and is set at the restraining position, or in cases where the locking means is not moved to the position for the lock release and is set at the position for the locking, the lighting operation of the operation member cannot be carried out and is locked. When the restraining means is moved from the restraining position to the un-restraining position and the locking means is moved from the position for the locking to the position for the lock release, the lighting operation of the operation member can be carried out. With the lighting operation of the operation member, the fuel gas is jetted and lighted, and the combustion can thus be begun. Since the fuel gas can be lighted and burned only when the restraining means and the locking means are operated simultaneously, appropriate lighting control functions can be obtained.

Also, with the second lighting device in accordance with the present invention, when the lock releasing operation of the locking means is continued, successive lighting operations of the operation member can be carried out. Therefore, in cases where a fire could not be lighted with a single lighting operation, a re-lighting operation can be carried out easily. Thus the second lighting device in accordance with the present invention has good operability. Furthermore, the returning to the state of the locking of the lighting operation can be carried out accompanying the movement of the locking means to the position for the locking.

BRIEF DESCRIPTION OF THE DRAWINGS

FIG. 23A is an exploded perspective view of FIG. 22, FIG. 23B is a perspective view showing a back surface side of a locking member shown in FIG. 23A, FIG. 23C is a perspective view showing a back surface side of a restraining member shown in FIG. 23A, FIGS. 24A and 24B are sectional perspective views showing the major part of the lighting rod, the views serving as an aid in explaining how the fifth embodiment of FIG. 22 operates.

DESCRIPTION OF THE PREFERRED EMBODIMENTS

The present invention will hereinbelow be described in further detail with reference to the accompanying drawings.

First Embodiment

Figure 1:
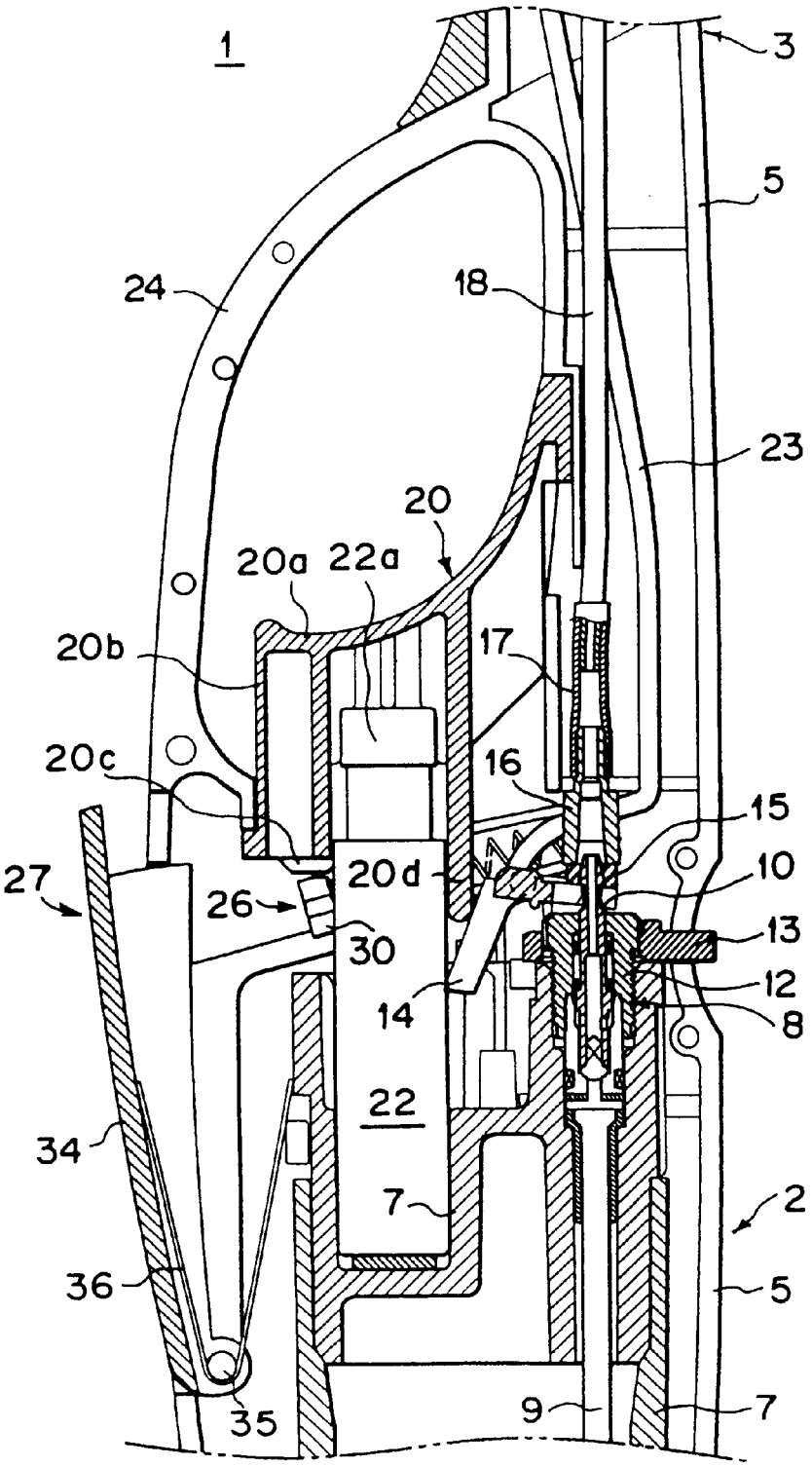
FIG. 1 is a vertical sectional side view showing the major part of a first embodiment of the lighting device in accordance with the present invention, which takes on the form of a lighting rod.

FIG. 1 is a vertical sectional side view showing the major part of a first embodiment of the lighting device in accordance with the present invention, which takes on the form of a lighting rod.

A lighting rod 1 comprises a main body 2 and an extension 3, which has a rod-like shape and extends from the main body 2. (A top end of the extension 3 is not shown in FIG. 1.) The housing of the main body 2 is constituted of a case housing 5, which is made from a synthetic resin and is divided into two parts approximately along a vertical center line. One of the two divided parts is shown in FIG. 1 and those that follow.

A gas tank 7 is located in the case housing 5 and on the base end side of the main body 2. The gas tank 7 is formed from a synthetic resin and accommodates a high pressure gas, such as a butane gas. A valve mechanism 8, which opens and closes a gas flow path, is located at an upper wall of the gas tank 7. The gas is fed to the valve mechanism 8 through a core 9, which is inserted into the gas tank 7. A nozzle member 10 is interleaved in the gas flow path. One end of a rotatable lever 14, which operates the nozzle member 10 in order to open and close the gas flow path, is engaged with a portion of the nozzle member 10 adjacent to its top end. When the nozzle member 10 is moved forwardly by the rotatable lever 14, the gas flow path is opened, and the gas is supplied through the gas flow path. When the nozzle member 10 retreats to the initial position by the urging force of a spring, which is located in the valve mechanism 8, the gas flow path is closed, and the supply of the gas is ceased. The gas supply rate, i.e. the size of a flame produced, is adjusted by rotating a flame adjusting knob 13, which is associated with an adjustment sleeve 12 of the valve mechanism 8 and is projected to the exterior of the main body 2.

A shield packing 15, which is constituted of an elastic material, is fitted to the top end of the nozzle member 10. A sleeve member 16, which is in contact with the shield packing 15, is located along a line extending from the nozzle member 10. One end of a connector pipe 17 is connected to an upper end of the sleeve member 16, and the other end of the connector pipe 17 is connected to an end of a gas pipe 18. The gas pipe 18 extends to the top end of the extension 3 and is connected to a jetting nozzle (not shown) in order to supply the gas to it.

Also, an operation member (in this case, a lighting push button) 20 is located along a side of the valve mechanism 8 in the case housing 5 of the main body 2. The operation member 20 can slide along the center line of the valve mechanism 8. A piezo-electric unit 22 is located between the operation member 20 and the gas tank 7.

Figure 3B:
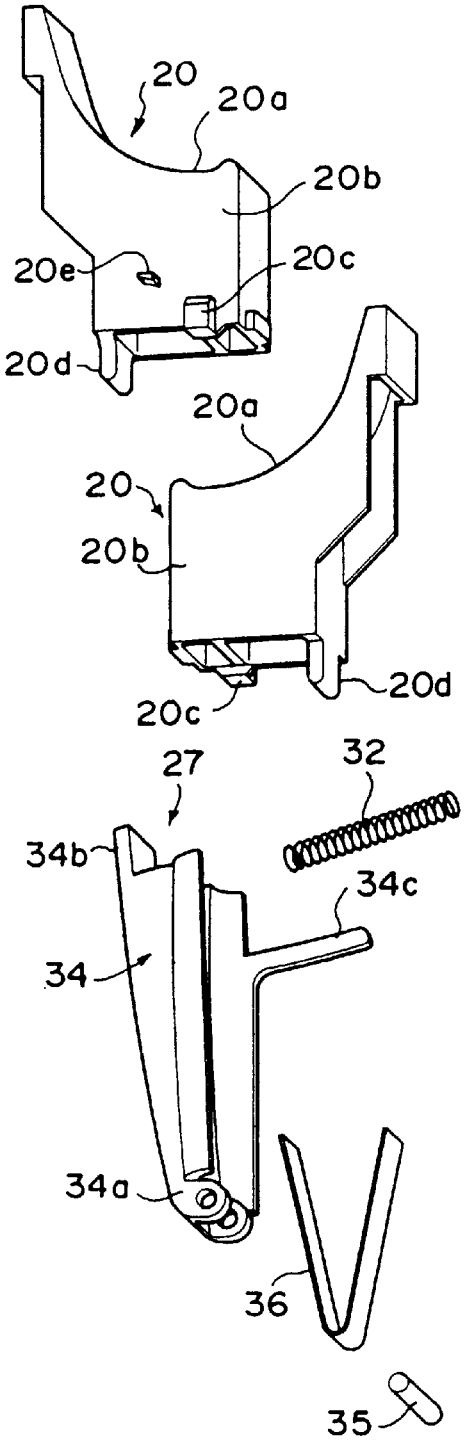
FIG. 3B is a perspective view showing a back surface side of an operation member shown in FIG. 3A.
Figure 3A:
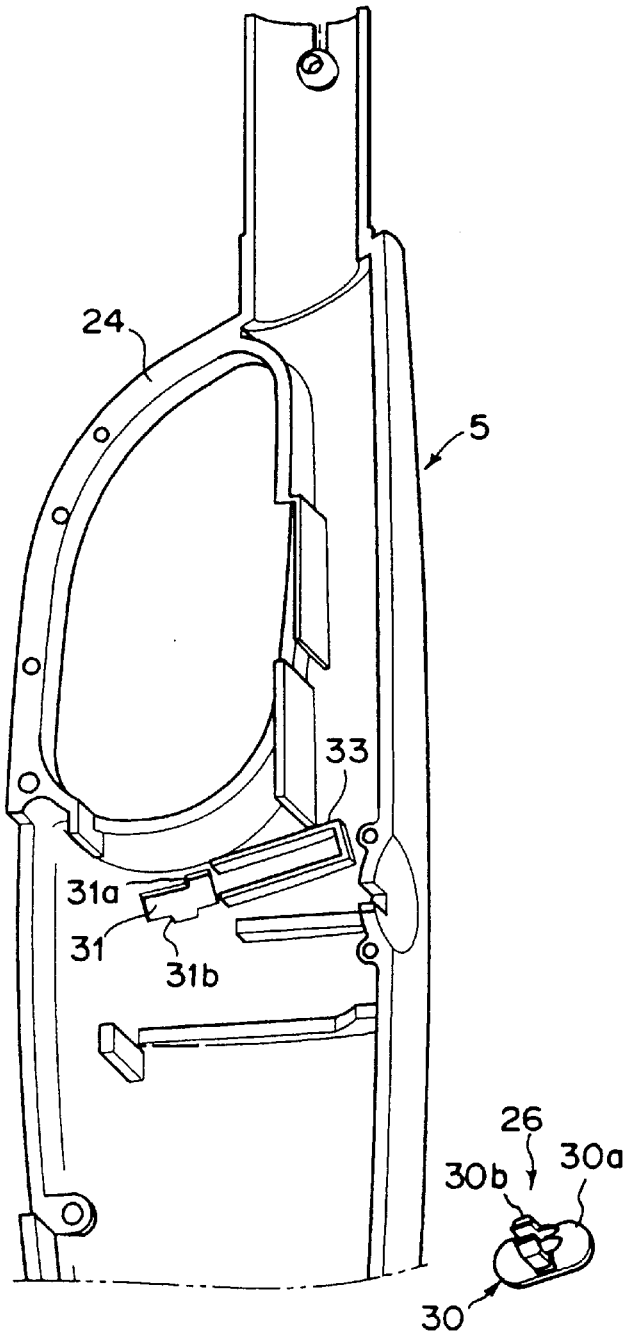
FIG. 3A is an exploded perspective view of FIG. 2.

The operation member 20 has a box-like section 20*b*, which is supported by the case housing 5 such that it can slide. An operating section 20*a* is obliquely formed at the top end of the box-like section 20*b*. As illustrated in FIG. 3B, an abutment projection 20*c* and a retention releasing projection 20*e*, which will be described later, are formed on one side surface of the box-like section 20*b*. Also, the lower end of a side surface of the box-like section 20*b*, which side surface is located on the side of the valve mechanism 8, continues into a leg 20*d*, which extends in the direction, along which the box-like section 20*b* slides. When the operation member 20 is pushed down in order to light the gas, the leg 20*d* engages with the end of the rotatable lever 14 and thereby rotates the rotatable lever 14.

Specifically, the rotatable lever 14 has an approximately L-shaped form and is supported such that it can rotate around a fulcrum, which is located at an intermediate point of the rotatable lever 14. As described above, the rotatable lever 14 is rotated by the leg 20*d* of the operation member 20. When the operation member 20 is moved for the lighting operation, the rotatable lever 14 is rotated in order to pull out the nozzle member 10 of the valve mechanism 8. As a result, the gas flow path is opened, and the gas is supplied to the jetting nozzle.

The piezo-electric unit 22 supplies a discharge voltage to an electrical discharge electrode. The piezo-electric unit 22 has a slide section 22*a* for expansion and contraction, which is fitted into the box-like section 20*b* of the operation member 20. When the operation member 20 is pushed down, the slide section 22*a* immerses and causes the piezo-electric unit 22 to generate the discharge voltage. Two lead wires 23, 23 are connected to electrodes of the piezo-electric unit 22 and extend in the extension 3 to the top end of the extension 3. At the top end of the extension 3, the lead wires 23, 23 are connected to the jetting nozzle and the electrical discharge electrode.

The case housing 5 is combined integrally with a guide frame 24, which surrounds the side outward from the operating section 20*a* of the operation member 20 such that the space, into which the fingers of the user are to be inserted, may be formed.

The lighting rod 1 having the structure described above is also provided with a lighting control mechanism, which controls the lighting operation of the operation member 20.

As illustrated in FIG. 2 through FIGS. 9A and 9B, the lighting control mechanism is provided with a locking means 26, which obstructs and locks the lighting operation of the operation member 20, and a restraining means 27, which restrains the operation of the locking means 26. The lighting control mechanism is constituted such that, when the locking means 26 is moved from a position for locking to a position for lock release, a single lighting operation can be carried out with the operation member 20, and such that, when the lock releasing operation of the locking means 26 is carried out and the restraining means 27 is moved from an un-restraining position in a non-working state, in which the restraining means 27 is not subjected to an operation from the exterior, to a restraining position in a working state, successive lighting operations can be carried out with the operation member 20.

Specifically, a locking member 30 is located at an inner side surface of the case housing 5 and at a position inward from the operation member 20. The locking member 30 constitutes the locking means 26 for locking the push-down operation of the operation member 20. Also, a restraining member 34, which constitutes the restraining means 27, is located along a side of the locking member 30.

The locking member 30 comprises a flat plate-like operating section 30*a* and an interference projection 30*b*, which is projected from the back surface of the operating section 30*a*. A keyhole-like sliding groove 31 is perforated through the wall of the case housing 5. The locking member 30 is fitted into the sliding groove 31, such that the operating section 30*a* may be exposed to the outer surface of the case housing 5, and such that the interference projection 30*b* may be projected to the side inward from the case housing 5. The locking member 30 can be moved along the sliding groove 31 and horizontally between the position for the locking on the left side and the position for the lock release on the right side.

When the locking member 30 is set at the position for the locking, the interference projection 30*b* interferes with the abutment projection 20*c* of the operation member 20 and obstructs the push-down operation of the operation member 20. When the locking member 30 is moved to the position for the lock release, the retention releasing projection 20*e* of the operation member 20 can come into contact with the interference projection 30*b*.

A spring receiver 33 is located on the inner surface of the case housing 5 and at a portion extended from the sliding groove 31. One end of a first resilient member 32, which is constituted of a coiled spring, is secured to the spring receiver 33, and the first resilient member 32 is fitted in a contracted state into the spring receiver 33. The other end of the first resilient member 32 is engaged with the side surface of the interference projection 30*b* of the locking member 30. The first resilient member 32 urges the locking member 30 toward the position for the locking.

The sliding groove 31 extends in an approximately long groove-like shape from the position for the locking at the left end to the position for the lock release at the right end. The sliding groove 31 has a step-like first retaining section 31*a*, which is formed at a front side edge at the end on the side of the position for the lock release. The first retaining section 31*a* constitutes the retaining means, which retains the locking member 30 at the position for the lock release. When the operation member 20 is pushed down, the retention releasing projection (serving as the retention releasing means) 20*e* of the operation member 20 pushes the locking member 30, which is retained by the first retaining section 31*a*, and thereby releases the locking member 30 from the first retaining section 31*a*. The sliding groove 31 also has a step-like second retaining section 31*b*, which is formed at an intermediate portion of a side edge. The second retaining section 31*b* retains the locking member 30 at an intermediate point of its returning movement. The interference projection 30*b* of the locking member 30 is formed such that the head portion may be larger than the width of the sliding groove 31, and such that the base portion may be narrower than the width of the sliding groove 31 and can move in the sliding groove 31.

The restraining member 34 is located at a position continuing to the position under the guide frame 24 of the case housing 5. A base end 34*a* on the lower side of the restraining member 34 is supported for rotation on the case housing 5 by a pin 35. The restraining member 34 has an operating section 34*b* on the front side, which is to be operated by the user and can be projected from the surface of the case housing 5. The operating section 34*b* can be swung between the un-restraining position, which is projected from the surface of the case housing 5, and the restraining position, which is flush with the surface of the case housing 5.

A lever section 34*c*, which extends toward the locking member 30, is formed at a portion of an inner edge of a side plate, which extends from the operating section 34*b* of the restraining member 34 into the case housing 5. Also, a second resilient member 36, which is constituted of a leaf spring, is threaded over the pin 35. The restraining member 34 is urged by the urging force of the second resilient member 36 toward the un-restraining position, at which the operating section 34*b* is projected from the surface of the case housing 5. When the restraining member 34 is set at the un-restraining position, an upper side of the lever section 34*c* covers the second retaining section 31*b*, which is formed at the intermediate point of the sliding groove 31, such that the lower edge of the sliding groove 31 may become straight. When the restraining member 34 is moved toward the case housing 5 and is set at the restraining position, the lever section 34*c* rotates in the direction heading away from the sliding groove 31 and opens the second retaining section 31*b*. In this state, the locking member 30 can be engaged with the second retaining section 31*b*.

Figure 2:
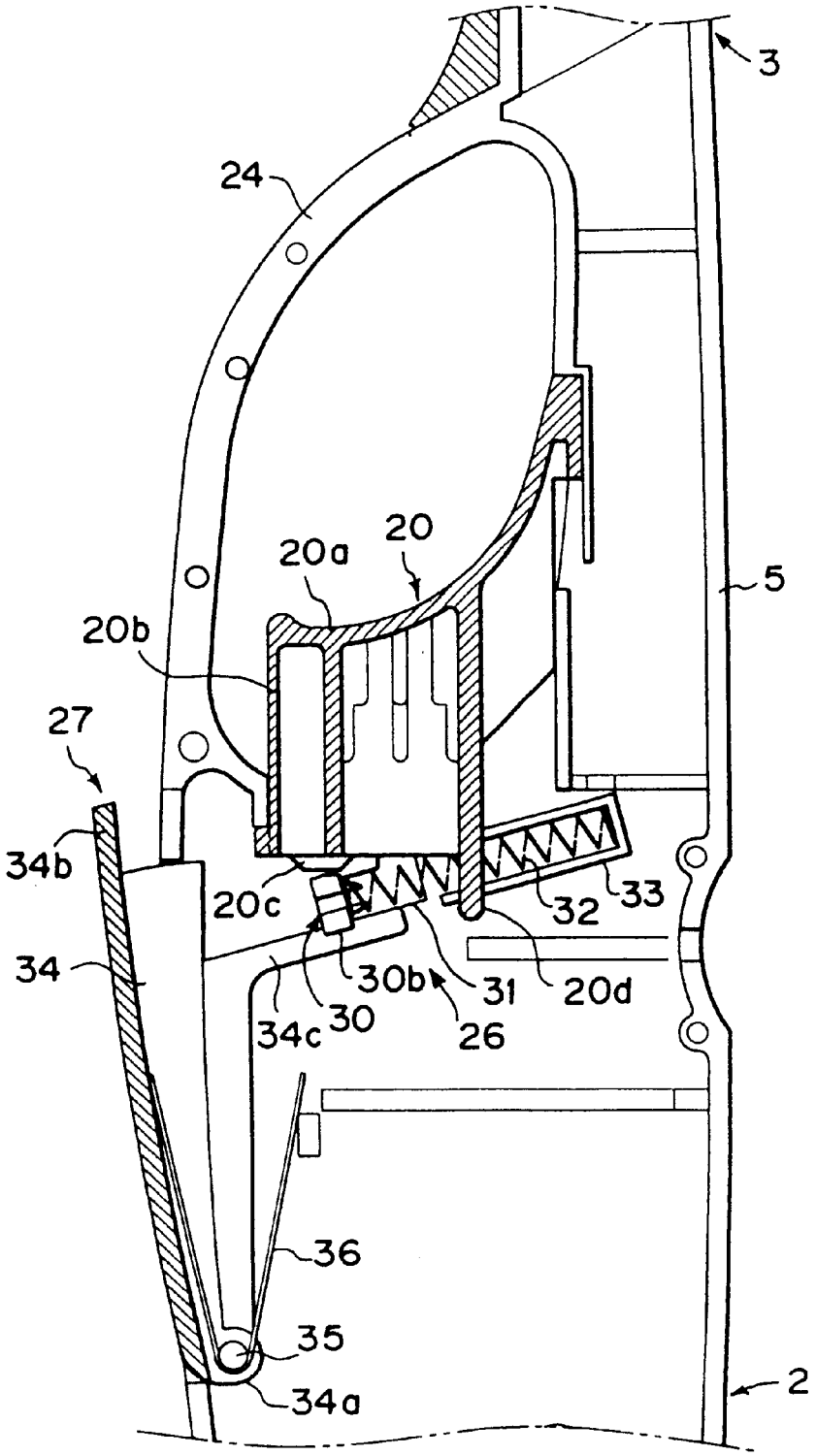
FIG. 2 is a sectional side view showing only the parts related to a lighting control mechanism in the embodiment of FIG. 1.
Figure 4:
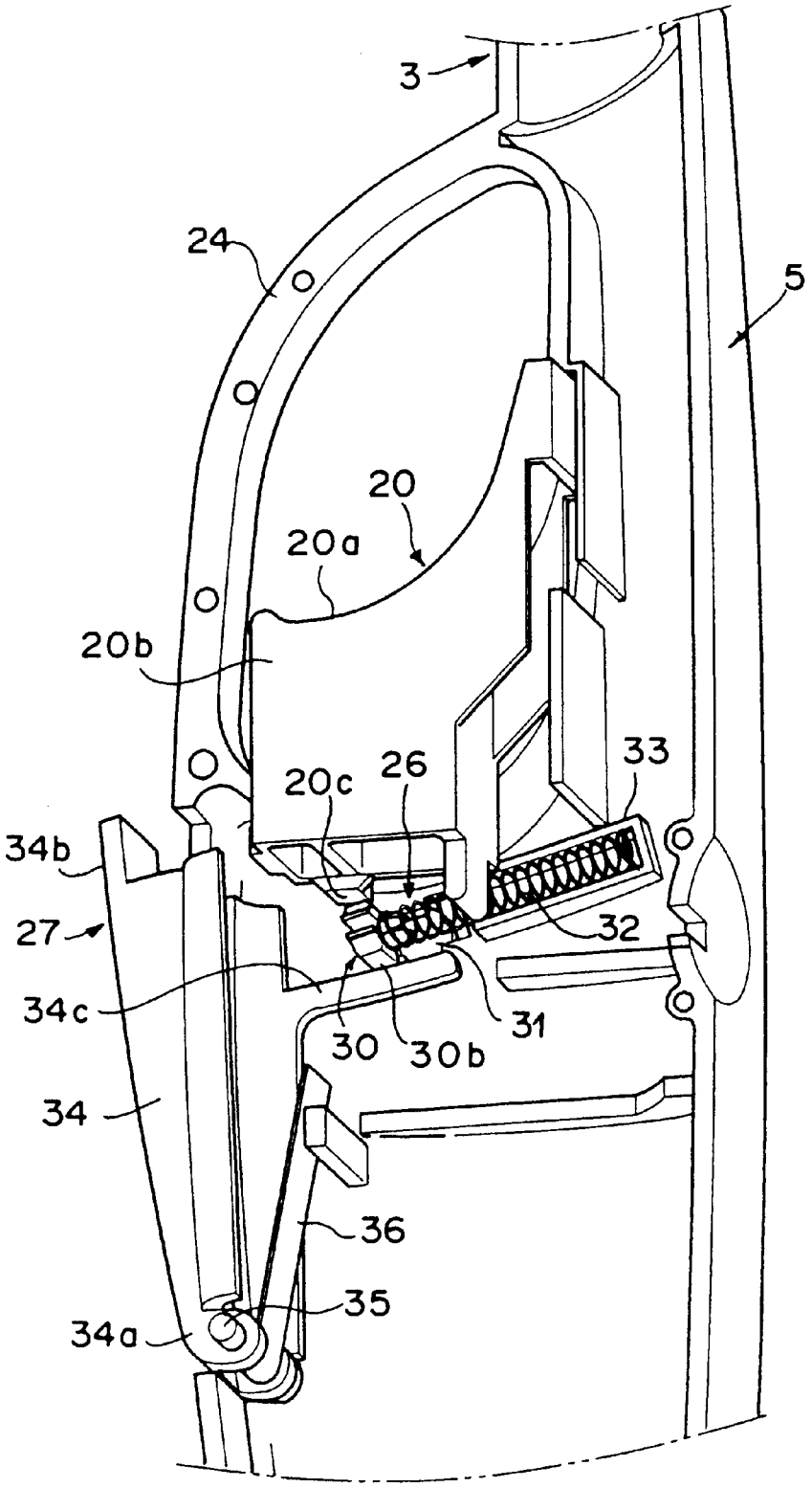
FIG. 4 is a perspective view showing an assembled form of the parts shown in FIG. 2, FIGS. 5A, 5B, 6A, 6B, 7A, 7B, 8A, 8B, 9A, and 9B are sectional side views showing the major part of the lighting rod, the views serving as an aid in explaining how the first embodiment of FIG. 1 operates.

How the lighting control mechanism of the lighting rod 1 operates will be described hereinbelow. In FIGS. 2, 4, and 5A, the locking member 30 is set at the position for the locking, the restraining member 34 is set at the un-restraining position (i.e., in the un-operated state), and the operation member 20 is in the un-operated state and is projected toward the guide frame 24. In this state, the locking member 30 is located at the left position for interference, and the interference projection 30*b* of the locking member 30 is located in front of the abutment projection 20*c* of the operation member 20 and interferes with the abutment projection 20*c*. Therefore, the push-down operation of the operation member 20 cannot be carried out, and the lighting operation cannot be carried out. In this state, even if the restraining member 34 is moved from the un-restraining position to the restraining position, no effect will occur upon the locking member 30.

Figure 5B:
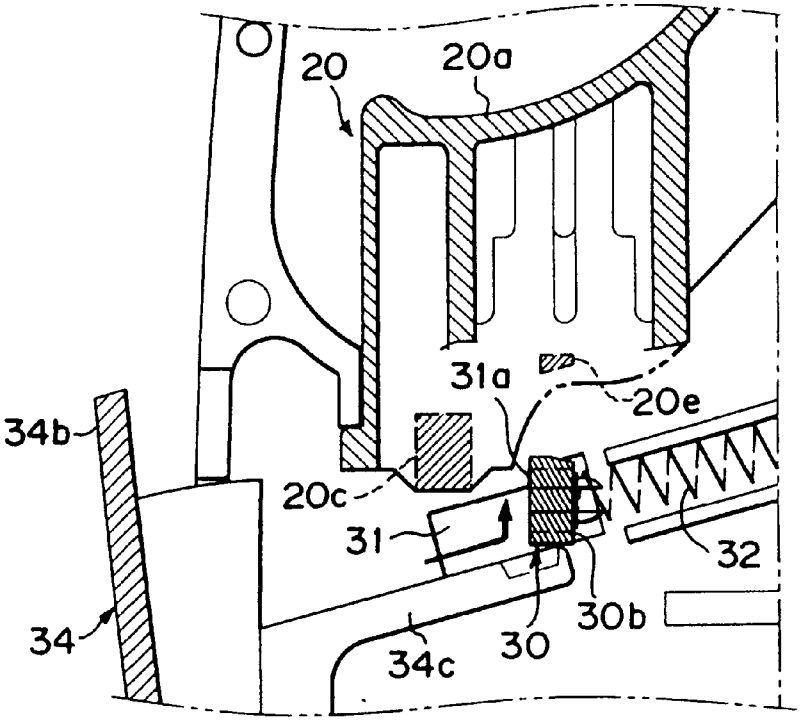
Figure 5A:
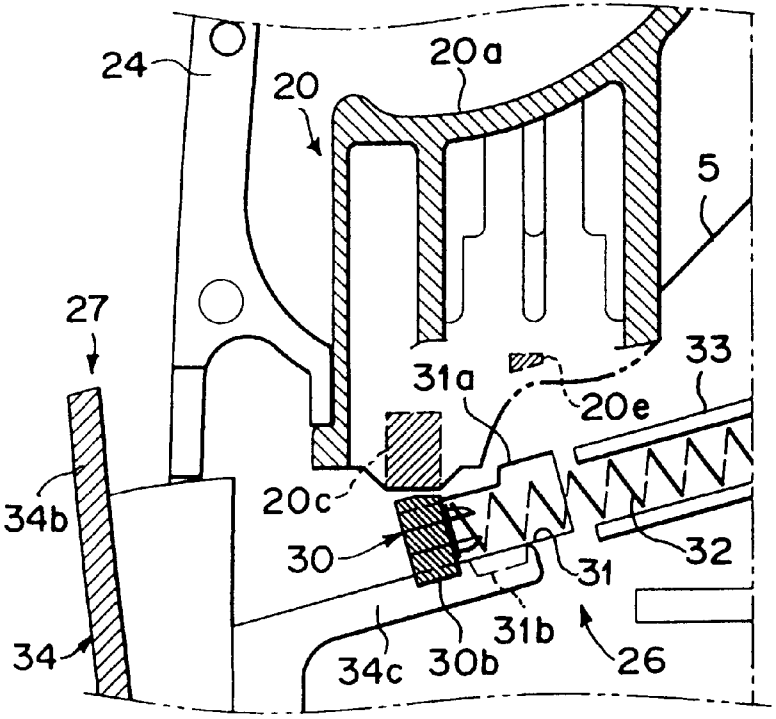

As illustrated in FIG. 5B, when the lighting rod 1 is to be used, the operating section 30*a* of the locking member 30 is slid to the right position for the lock release against the urging force of the first resilient member 32. As a result, the locking member 30 is moved along the sliding groove 31, is engaged with the first retaining section 31*a* formed at the end of the sliding groove 31, and is retained at the position for the lock release. When the locking member 30 is thus moved to the position for the lock release, the interference projection 30*b* of the locking member 30 moves from the position for the interference in front of the abutment projection 20*c* of the operation member 20 to the position for the lock release. Therefore, the operation member 20 can be pushed down, and the lighting operation can be carried out.

When the operation member 20 is thus pushed down for the lighting operation, the leg 20*d* of the operation member 20 pushes the end of the rotatable lever 14 and rotates the rotatable lever 14. As a result, the rotatable lever 14 pulls out the nozzle member 10 and opens the gas flow path in the valve mechanism 8. Therefore, the gas is supplied through the gas pipe 18 to the jetting nozzle. Also, as the operation member 20 is operated in this manner, the piezo-electric unit 22 is caused to generate the discharge voltage (an alternating voltage). The discharge voltage is applied across the electrical discharge electrode, which is located at the extension 3, and the jetting nozzle, and the jetted gas is lighted by the discharge voltage.

Figure 6B:
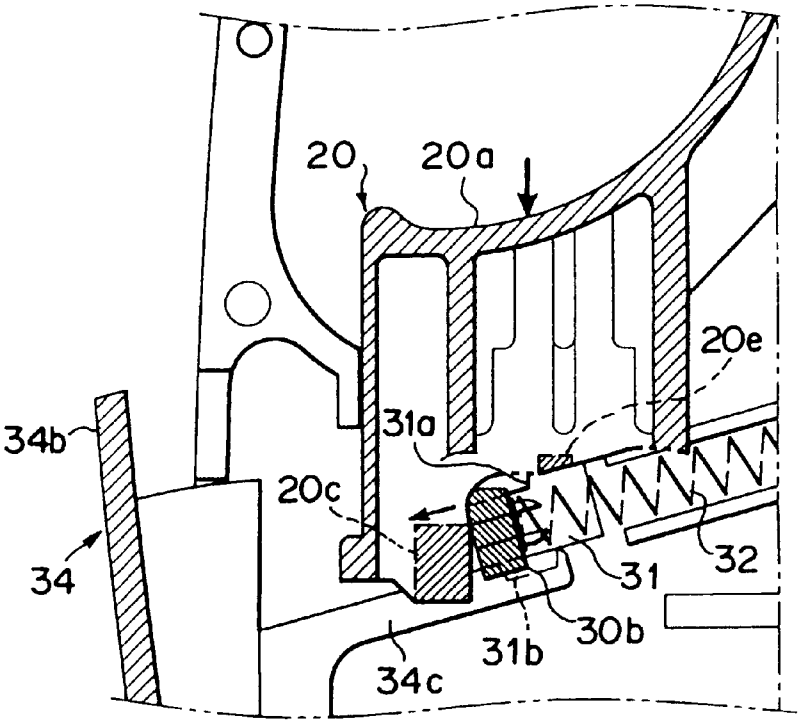
Figure 6A:
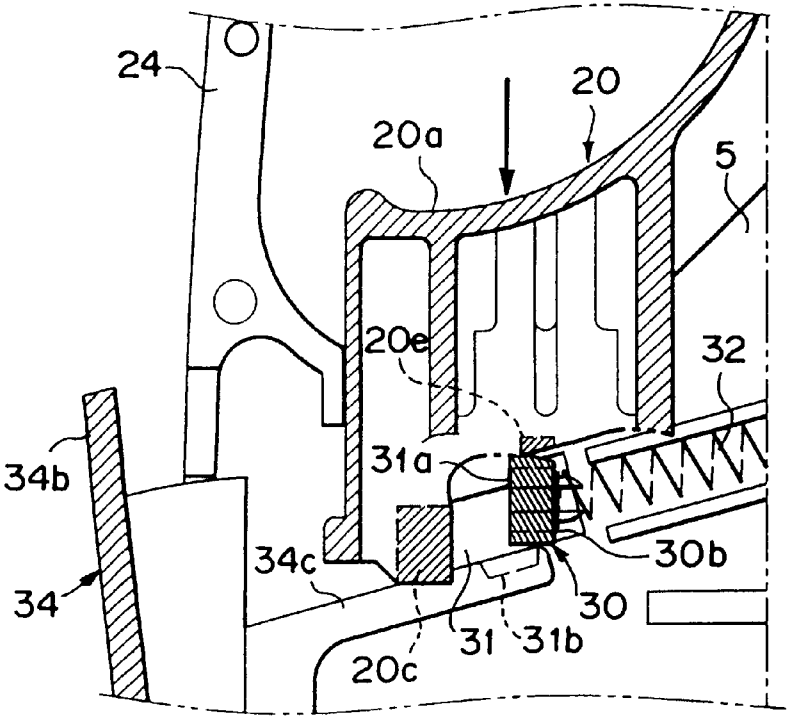

As illustrated in FIG. 6A, when the operation member 20 is pushed down, the retention releasing projection 20*e* of the operation member 20 comes into contact with the interference projection 30*b* of the locking member 30, causes the interference projection 30*b* to move, and thereby disengages the interference projection 30*b* from the first retaining section 31*a*. As a result, the locking member 30 is moved in the leftward returning direction by the urging force of the first resilient member 32. As illustrated in FIG. 6B, the locking member 30 is stopped at an intermediate point of the returning movement, at which the interference projection 30*b* is in contact with the side surface of the abutment projection 20*c* of the operation member 20.

When the operation member 20 is released from the pushing force, the operation member 20 is returned to the initial position by the urging force of a spring, which is located in the piezo-electric unit 22. Also, as illustrated in FIG. 5A, the locking member 30 is moved to the end of the sliding groove 31 by the resilient force of the first resilient member 32, and the interference projection 30*b* of the locking member 30 moves to the position for the interference with the abutment projection 20*c* of the operation member 20. In this manner, the locking member 30 automatically returns to the initial state of the locking, in which the operation member 20 cannot be pushed down.

As described above, when the locking member 30 is moved from the position for the locking to the position for the lock release, a single lighting operation with the operation member 20 can be carried out. Thereafter, the locking member 30 automatically returns to the state of the locking of the lighting operation. At this time, the restraining member 34 is not operated and is kept at the un-restraining position.

Figure 7B:
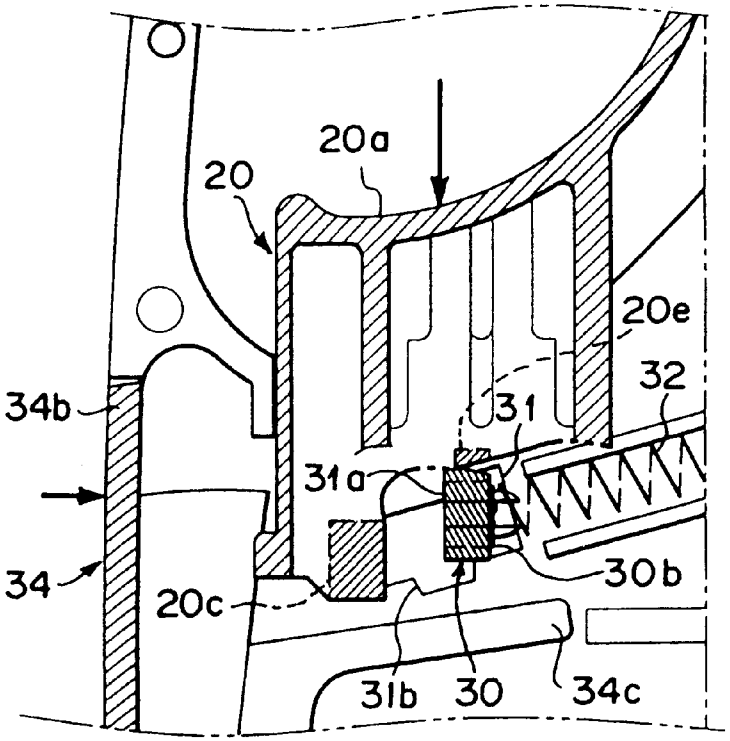
Figure 7A:
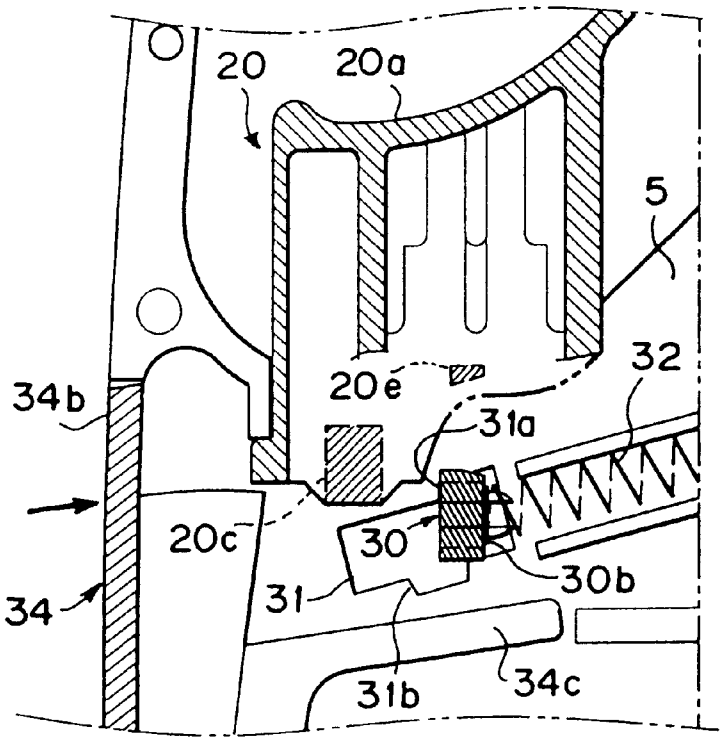

As illustrated in FIG. 7A, in cases where successive lighting operations are to be carried out, the locking member 30 is moved from the position for the locking to the position for the lock release, and the operating section 34*b* of the restraining member 34 is pushed into the case housing 5. The restraining member 34 is thus moved from the un-restraining position to the restraining position. As the restraining member 34 is thus operated, the lever section 34*c* of the restraining member 34 rotates and opens the second retaining section 31*b*, which is formed at an intermediate portion of the sliding groove 31.

The operation member 20 is then pushed down for the lighting operation. As a result, as illustrated in FIG. 7B, the retention releasing projection 20*e* of the operation member 20 comes into contact with the interference projection 30*b* of the locking member 30 and releases the retention of the interference projection 30*b* at the first retaining section 31*a*. The locking member 30 begins moving in the returning direction with the urging force of the first resilient member 32.

Figure 8B:
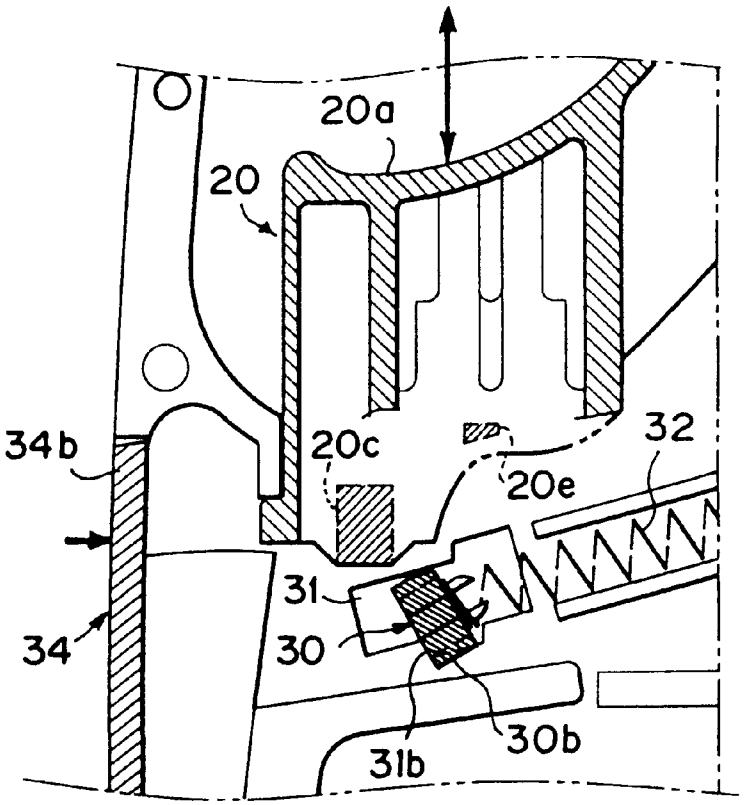
Figure 8A:
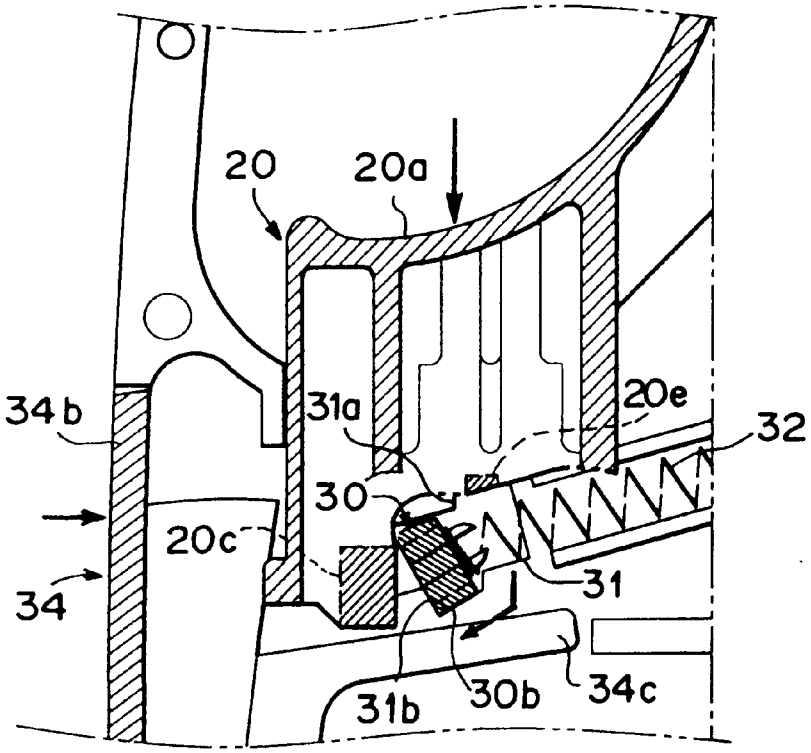

At this time, as illustrated in FIG. 8A, the interference projection 30*b* of the locking member 30 is engaged with the second retaining section 31*b* formed at the intermediate portion of the sliding groove 31 and is stopped at the intermediate point of the returning movement. In this state, as illustrated in FIG. 8B, even if the operation member 20 is released from the pushing force and returned to the initial position, the locking member 30 will be retained at the second retaining section 31*b*, and the interference projection 30*b* will not return to the position for the interference with the abutment projection 20*c*.

Therefore, with the restraining member 34 being kept at the restraining position by being pushed in continuously, the locking member 30 is retained at the position that does not interfere with the operation member 20, and the lighting operation with the operation member 20 can be carried out repeatedly.

In cases where the successive lighting operations are to be finished, the operation member 20 and the restraining member 34 are released from the pushing force. As a result, as illustrated in FIG. 9A, the restraining member 34 is rotated toward the un-restraining position by the urging force of the second resilient member 36, and the upper side of the lever section 34*c* pushes the interference projection 30*b* of the locking member 30 upwardly from the second retaining section 31*b* and thereby disengages the interference projection 30*b* from the second retaining section 31*b*.

Figure 9B:
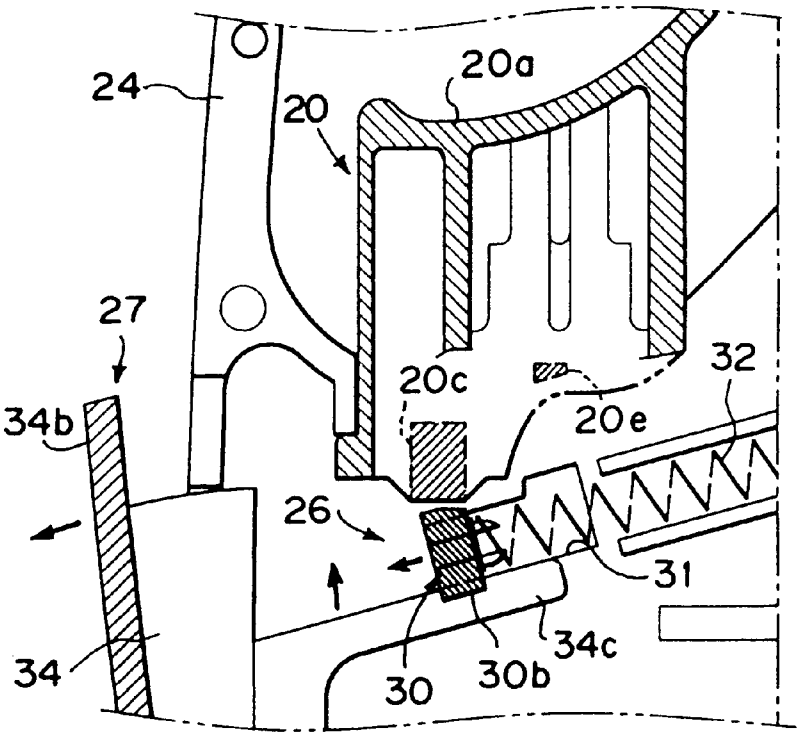
Figure 9A:
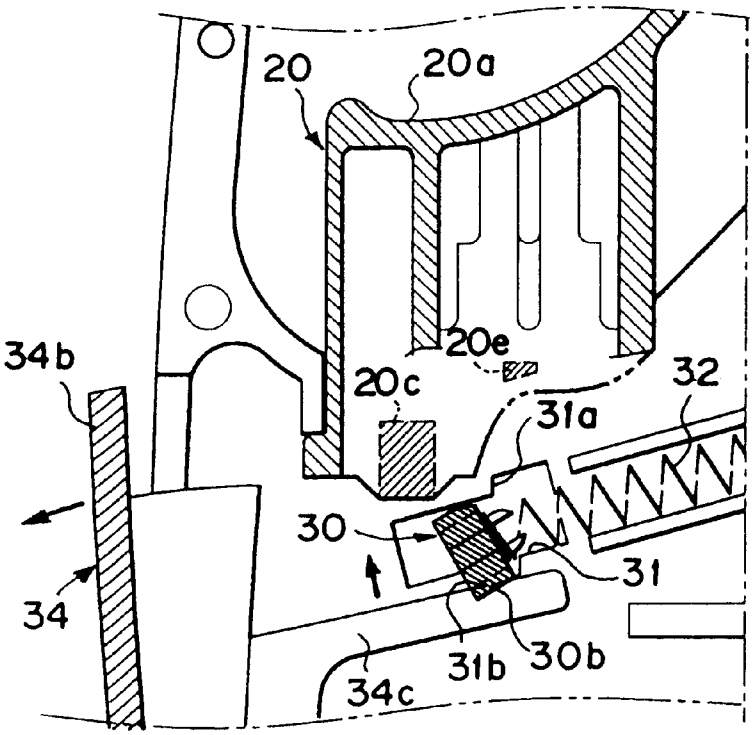

Accordingly, as illustrated in FIG. 9B, the locking member 30 is moved to the end of the sliding groove 31 by the urging force of the first resilient member 32. In this manner, the locking member 30 returns to the position for the locking that can interfere with the abutment projection 20*c* of the operation member 20.

Second Embodiment

Figure 10:
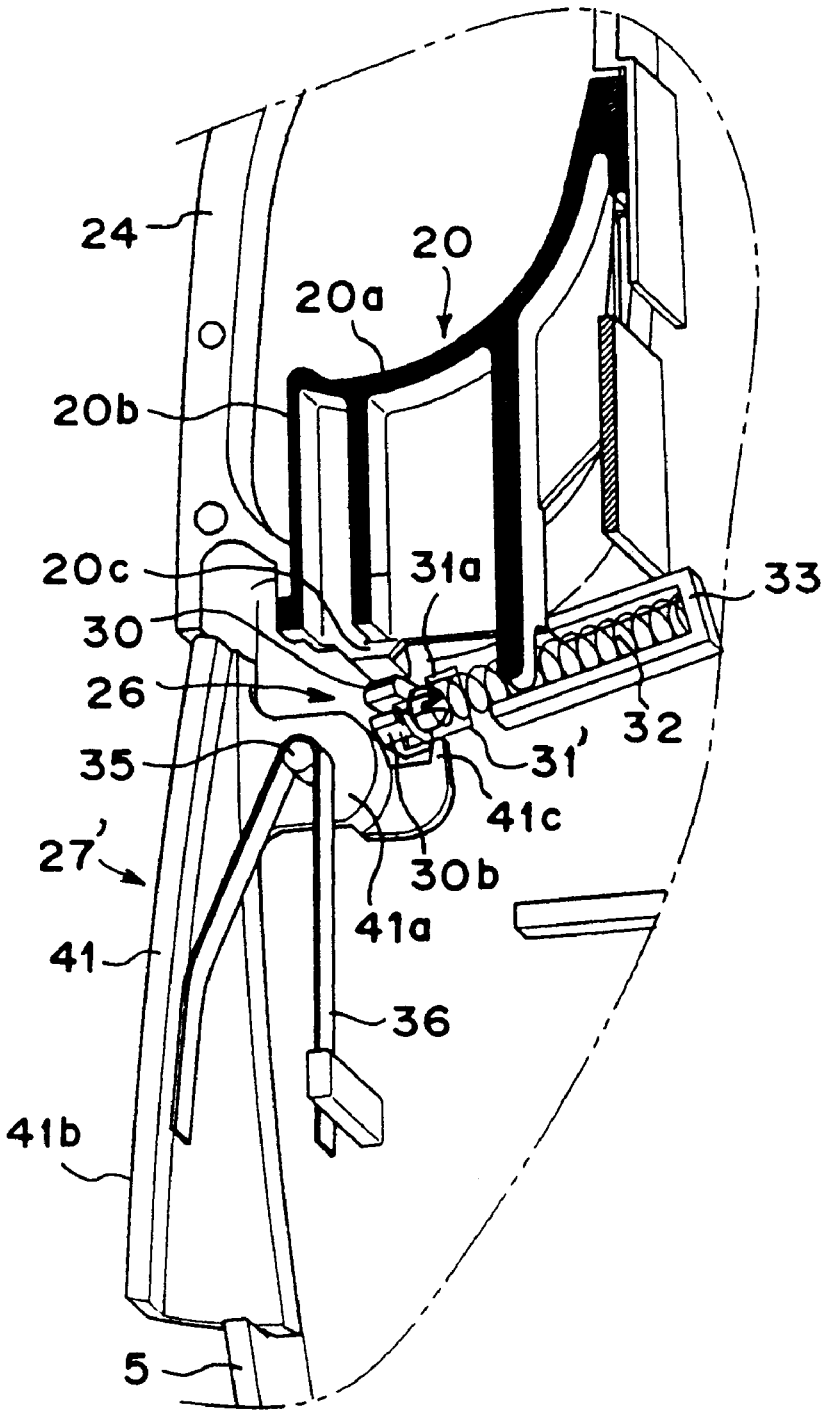
FIG. 10 is a sectional side view showing the major part of a second embodiment of the lighting device in accordance with the present invention, which takes on the form of a lighting rod.
Figure 11B:
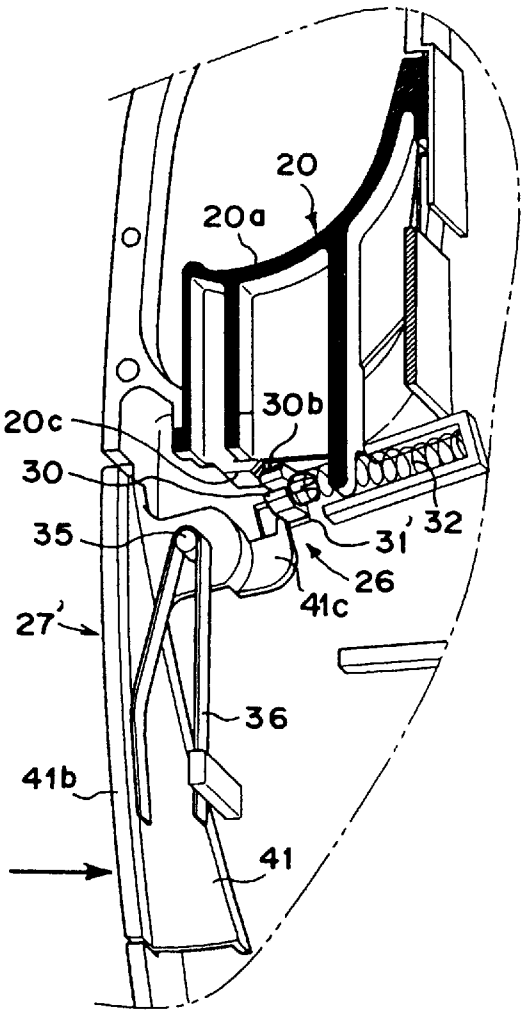
FIGS. 11A and 11B are sectional perspective views showing the major part of the lighting rod, the views serving as an aid in explaining how the second embodiment of FIG. 10 operates.
Figure 11A:
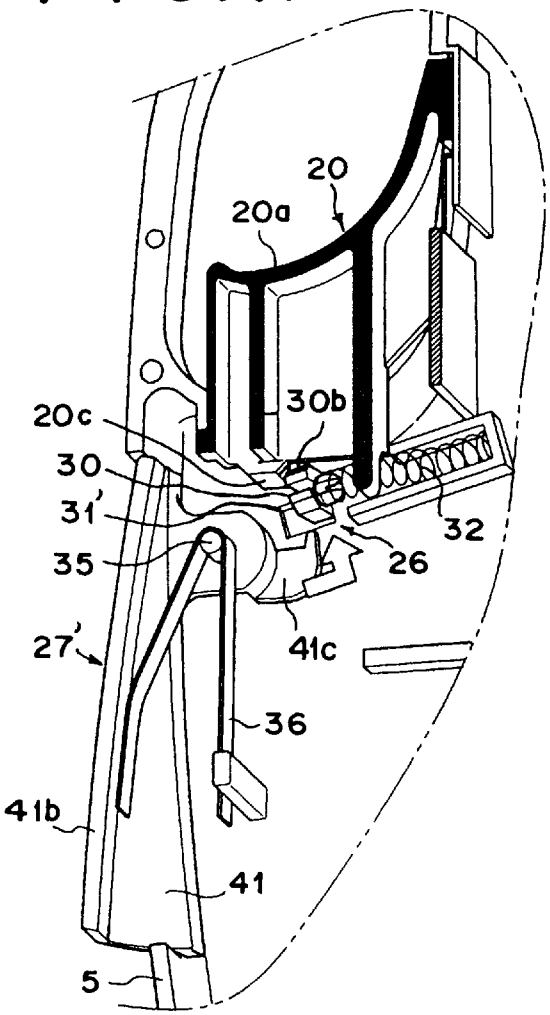
Figure 12:
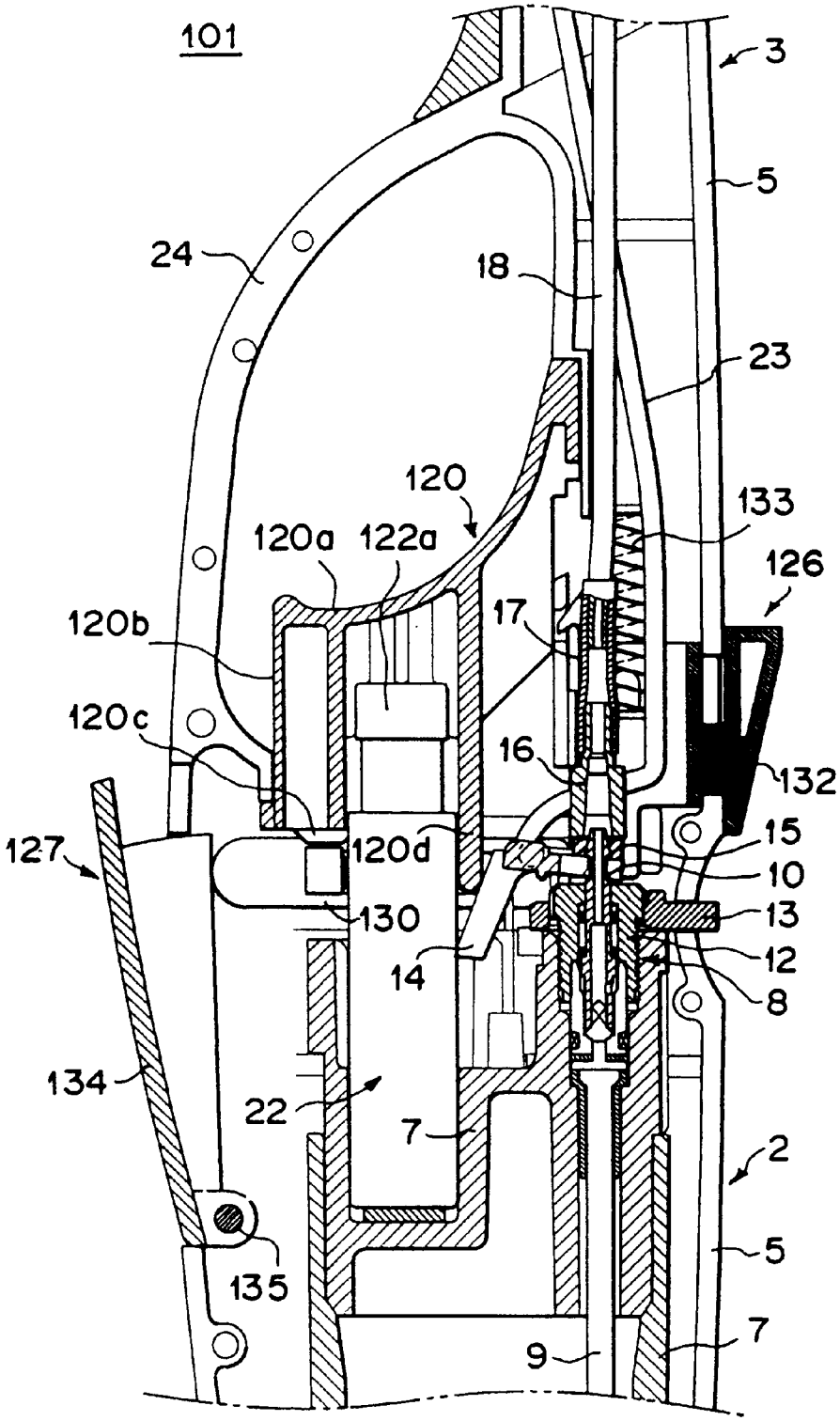
FIG. 12 is a vertical sectional side view showing the major part of a third embodiment of the lighting device in accordance with the present invention, which takes on the form of a lighting rod.

A second embodiment of the lighting device in accordance with the present invention, which takes on the form of a lighting rod, will be described hereinbelow with reference to FIG. 10 and FIGS. 11A, 11B. In FIG. 10 and FIGS. 11A, 11B (and in those that follow), similar elements are numbered with the same reference numerals with respect to FIGS. 1, 2, 3A, 3B, and 4. In the second embodiment, the locking member 30 of the locking means 26, which obstructs and locks the lighting operation of the operation member 20, is constituted in the same manner as that in the first embodiment described above. A restraining member 41 of a restraining means 27', which restrains the operation of the locking member 30, is constituted in a manner different from that in the first embodiment.

As in the aforesaid first embodiment, the locking member 30 has the interference projection 30*b*, which interferes with the abutment projection 20*c* of the operation member 20. A sliding groove 31', in which the locking member 30 slides, is provided with the first retaining section 31*a*, which retains the locking member 30 at the position for the lock release, as in the aforesaid first embodiment. However, the sliding groove 31' is not provided with the second retaining section 31*b*, which is formed at the intermediate portion of the sliding groove 31 in the first embodiment.

A base end 41*a* on the upper side of the restraining member 41 is supported for rotation on the case housing 5 by the pin 35. The restraining member 41 has an operating section 41*b* on the front side, which is to be operated by the user and can be projected from the surface of the case housing 5. The operating section 41*b* can be swung between the un-restraining position, which is projected from the surface of the case housing 5, and the restraining position, which is flush with the surface of the case housing 5.

Also, the restraining member 41 has a hook-like retaining section 41*c*, which extends from the base end 41*a* into the case housing 5. The retaining section 41*c* retains the locking member 30 at an intermediate point of the returning movement. Specifically, when the restraining member 41 is set at the un-restraining position, the end of the retaining section 41*c* is located at a position retreated from the sliding groove 31' and does not interfere with the locking member 30, which moves along the sliding groove 31. When the restraining member 41 is pushed into the case housing 5 and is set at the restraining position, the end of the retaining section 41*c* is projected into the sliding groove 31' and can engage with the locking member 30.

The restraining member 41 is urged by the urging force of the second resilient member 36, which is constituted of the leaf spring and is threaded over the pin 35, toward the un-restraining position, at which the operating section 41*b* is projected from the surface of the case housing 5. The other features are the same as those in the aforesaid first embodiment.

In FIG. 10, the locking member 30 is set at the position for the locking, and the restraining member 41 is set at the un-restraining position. In this state, the interference projection 30*b* of the locking member 30 locks the push-down operation of the operation member 20, and the lighting operation cannot be carried out.

In FIG. 11A, the locking member 30 is slid to the position for the lock release, and the restraining member 41 is kept at the un-restraining position. In this state, the locking member 30 is engaged with the first retaining section 31*a* of the sliding groove 31' and is retained at the position for the lock release. As the locking member 30 is thus moved to the position for the lock release, the operation member 20 can be pushed down for the lighting operation. As in the first embodiment, when the operation member 20 is pushed down for the lighting operation, the retention releasing projection 20*e* of the operation member 20 comes into contact with the locking member 30 and disengages the locking member 30 from the first retaining section 31*a*. As a result, the locking member 30 is moved in the leftward returning direction by the urging force of the first resilient member 32 and automatically returns to the position for the locking. In this manner, when the locking member 30 is moved from the position for the locking to the position for the lock release, a single lighting operation with the operation member 20 can be carried out. Thereafter, the locking member 30 automatically returns to the state of the locking of the lighting operation.

In FIG. 11B, the locking member 30 is moved to the position for the lock release, the operating section 41*b* of the restraining member 41 is pushed into the case housing 5, and the restraining member 41 is thereby moved from the un-restraining position to the restraining position. In this state, successive lighting operations can be carried out. As the restraining member 41 is thus moved, the retaining section 41*c* of the restraining member 41 rotates, and the end of the retaining section 41*c* projects into the sliding groove 31'. Also, when the operation member 20 is pushed down for the lighting operation, the retention releasing projection 20*e* of the operation member 20 releases the retention of the locking member 30 at the first retaining section 31*a*, and the locking member 30 begins moving in the returning direction. However, at this time, the interference projection 30*b* of the locking member 30 comes into contact with the retaining section 41*c* of the restraining member 41, and the locking member 30 stops at the intermediate point of the returning movement. In this state, the locking member 30 does not move to the position for the locking and allows the successive lighting operations of the operation member 20. When the restraining member 41 is released from the pushing force, the retaining section 41*c* rotates and disengages from the locking member 30. As a result, the locking member 30 returns to the position for the locking. Therefore, the same functions as those in the first embodiment can be obtained.

The first and second embodiments described above may be modified in various other ways. For example, the locking means 26 may be located at the other side surface of the case housing 5. Also, as the movements accompanying the operations of the locking member 30 and the restraining member 34 or 41, besides the sliding and the rotation as in the aforesaid embodiments, push-in movements, and the like may be employed.

Third Embodiment

A third embodiment of the lighting device in accordance with the present invention, which takes on the form of a lighting rod, will be described hereinbelow with reference to FIG. 12 through FIGS. 18A, 18B. In the third embodiment, the operation member and the lighting control mechanism are different from those in the first embodiment, and the basic structure of a lighting rod (i.e., a lighting device) 101 is the same as that of the lighting rod 1 shown in FIG. 1.

In the third embodiment, an operation member 120 has a box-like section 120*b*, which is supported by the case housing 5 such that it can slide. An operating section 120*a* is obliquely formed at the top end of the box-like section 120*b*. An abutment projection 120*c*, which will be described later, is formed on one side surface of the box-like section 120*b*. Also, the lower end of a side surface of the box-like section 120*b*, which side surface is located on the side of the valve mechanism 8, continues into a leg 120*d*, which extends in the direction, along which the box-like section 120*b* slides. When the operation member 120 is pushed down in order to light the gas, the leg 120*d* engages with the end of the rotatable lever 14 and thereby rotates the rotatable lever 14.

As illustrated in FIG. 13 through FIGS. 18A, 18B, the lighting control mechanism is provided with a restraining means 126 and a locking means 127, which restrain the lighting operation of the operation member 120. With the lighting control mechanism, when the restraining means 126 is moved from the restraining position to the un-restraining position and, at the same time or successively, the locking means 127 is moved from the position for the locking to the position for the lock release, the lighting operation can be carried out with the operation member 120.

Specifically, the locking means 127 comprises a locking member 130 and a working member 134. The locking member 130 is located at an inner side surface of the case housing 5 and at a position inward from the operation member 120. The locking member 130 obstructs and locks the push-down operation of the operation member 120. The working member 134 can be operated from the exterior and moves the locking member 130 from the position for the locking to the position for the lock release. Also, the restraining means 126 is constituted of a restraining member 132, which restrains the movement of the locking member 130 to the position for the lock release. When the restraining member 132 is moved to the un-restraining position, the locking means 127 can be operated.

The locking member 130 of the locking means 127 has a link-like shape and has a long groove 130*a*, which is open at a middle portion. A guiding member 138, which is projected from the inner side surface of the case housing 5, is inserted into the long groove 130*a*, and the locking member 130 can be moved horizontally between the left position for the locking and the right position for the lock release. Inner ribs 5*b*, 5*b* are projected from the inner surface of the case housing 5 and at positions above and below the locking member 130.

Also, an interference projection 130*b* is formed at one end of the long groove 130*a* of the locking member 130. The interference projection 130*b* interferes with the abutment projection 120*c* of the operation member 120 and obstructs and locks the push-down operation of the operation member 120. A first resilient member (serving as the first resilient means) 131, which is constituted of a coiled spring, is fitted in a contracted state into the long groove 130*a*. The first resilient member 131 is fitted between a side surface of the guiding member 138 and a side surface of the interference projection 130*b* and urges the locking member 130 leftward toward the position for the locking.

The working member 134 of the locking means 127 is supported on the case housing 5 such that it can swing. The working member 134 is located at a position continuing from the position under the guide frame 24 of the case housing 5. A base end 134*a* of the working member 134 is supported for rotation on the case housing 5 by a pin 135. The working member 134 has an operating section 134*b* on the front side, which is to be operated by the user from the exterior and can be projected from the surface of the case housing 5. The operating section 134*b* can be swung between the position for the locking, which is projected from the surface of the case housing 5, and the position for the lock release, which is flush with the surface of the case housing 5.

Further, the working member 134 has a pushing section 134*c*, which is formed at an inner end of a side plate, which extends from the operating section 134*b* of the working member 134 into the case housing 5. The pushing section 134*c* can be brought into contact with an end 130*d* of the locking member 130.

Since the working member 134 comes into contact with the locking member 130, which is set at the position for the locking by the urging force of the first resilient member 131, the operating section 134*b* is projected from the surface of the case housing 5. When a restraining member 132, which will be described later, is set at the un-restraining position and the working member 134 is pushed into the case housing 5, the locking member 130 is moved rightward from the position for the locking to the position for the lock release against the urging force of the first resilient member 131.

The restraining means 126 is provided with the restraining member 132, which is located on the side of the case housing 5 opposite to the guide frame 24 and can slide in parallel with the direction of movement of the operation member 120. A portion of the restraining member 132 is exposed to the exterior from an opening 5*a* of the case housing 5. The restraining member 132 has an operating section 132*a*, which is to be slid by a finger (primarily the thumb) of the user. A connecting section 132*c*, which connects the operating section 132*a* and a support section 132*b*, slides in the opening 5*a* of the case housing 5. The operating section 132*a* and the support section 132*b* sandwich the wall of the case housing 5, and the restraining member 132 is thereby supported such that it can slide between the lower restraining position and the upper un-restraining position.

An engagement claw (i.e., a hook) 132*d*, which serves as an un-restraining position retaining means and can deform resiliently, is located on the side inward from the support section 132*b*. Also, an abutment section 132*e*, which projects rearward, is formed at a tail end portion (i.e., a lower end portion) of the support section 132*b*. The abutment section 132*e* projects to a position in front of the other end 130*c* of the locking member 130 and thereby obstructs the movement of the locking member 130 toward the position for the lock release.

A projection-like spring receiver 132*f* is located at a middle portion of the support section 132*b*. Also, a spring receiver 5*c* having an inverted U-shape is formed on the inner surface of the case housing 5. A second resilient member (serving as the second resilient means) 133, which is constituted of a coiled spring, is fitted in a contracted state between the spring receivers 132*f* and 5*c*. The second resilient member 133 urges the restraining member 132 toward the restraining position.

A flat plate-like wall 139, which extends in the direction of the sliding of the restraining member 132, is formed on the inner surface of the case housing 5 and along a side of the restraining member 132. The wall 139 has a leading end engagement section 139*a*. When the restraining member 132 is set at the un-restraining position, the engagement claw 132*d* of the restraining member 132 can engage with the leading end engagement section 139*a*. The wall 139 is also provided with a cutaway portion 139*b*, into which the engagement claw 132*d* is inserted when the restraining member 132 is set at the restraining position. The engagement claw 132*d* has an oblique surface at the leading end, and a retention releasing section (serving as the retention releasing means) 120*e* of the operation member 120 can come into contact with the oblique surface of the engagement claw 132*d*.

When the restraining member 132 is set at the restraining position, the locking member 130 is located at the position for the locking, and the abutment section 132*e* projects to the position for the interference with the other end 130*c* of the locking member 130. When the restraining member 132 is moved forwardly and set at the un-restraining position, the working member 134 can be moved for the lock release, and the locking member 130 can be moved to the position for the lock release.

Figure 13:
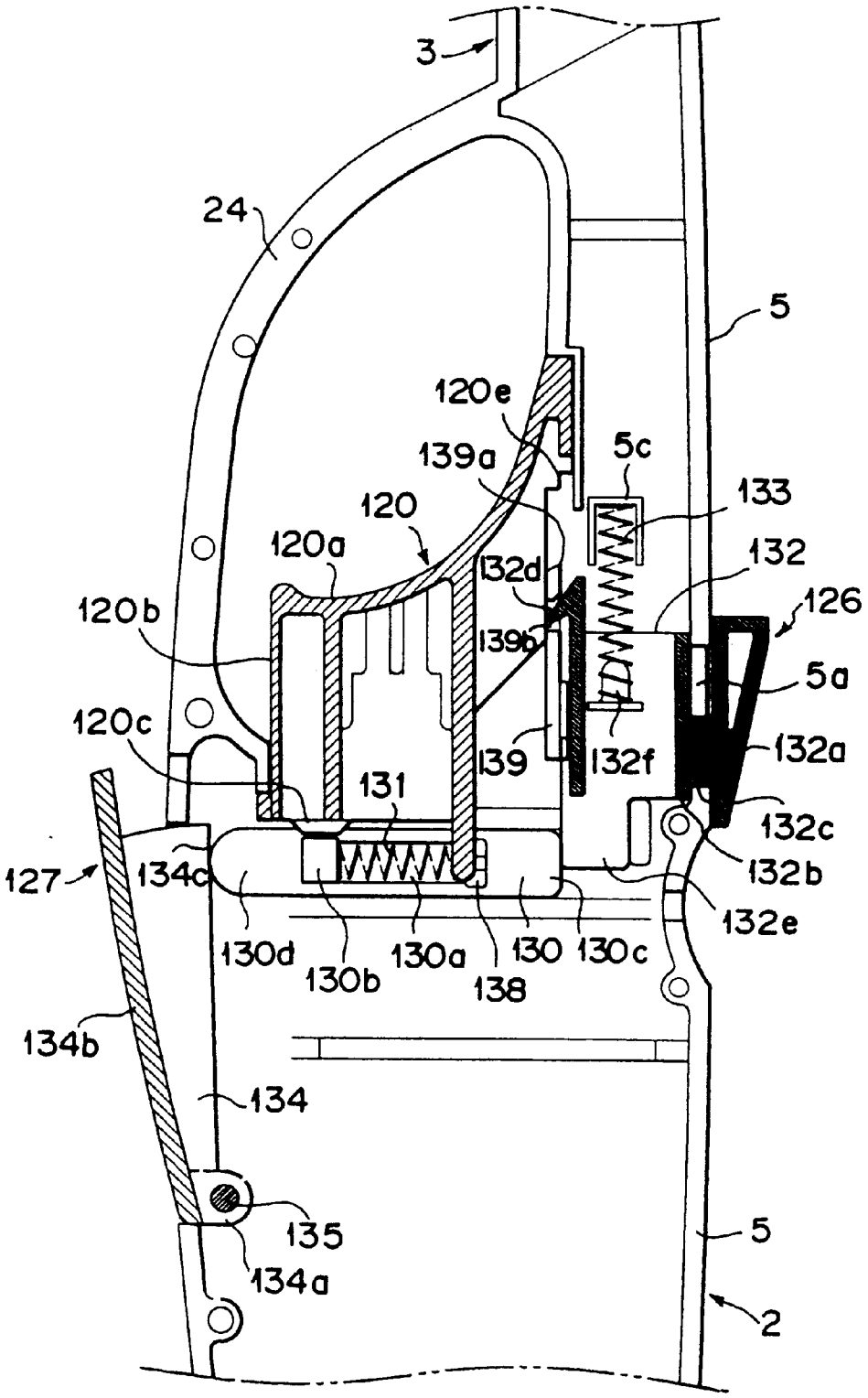
FIG. 13 is a sectional side view showing only the parts related to a lighting control mechanism in the embodiment of FIG. 12.
Figure 14:
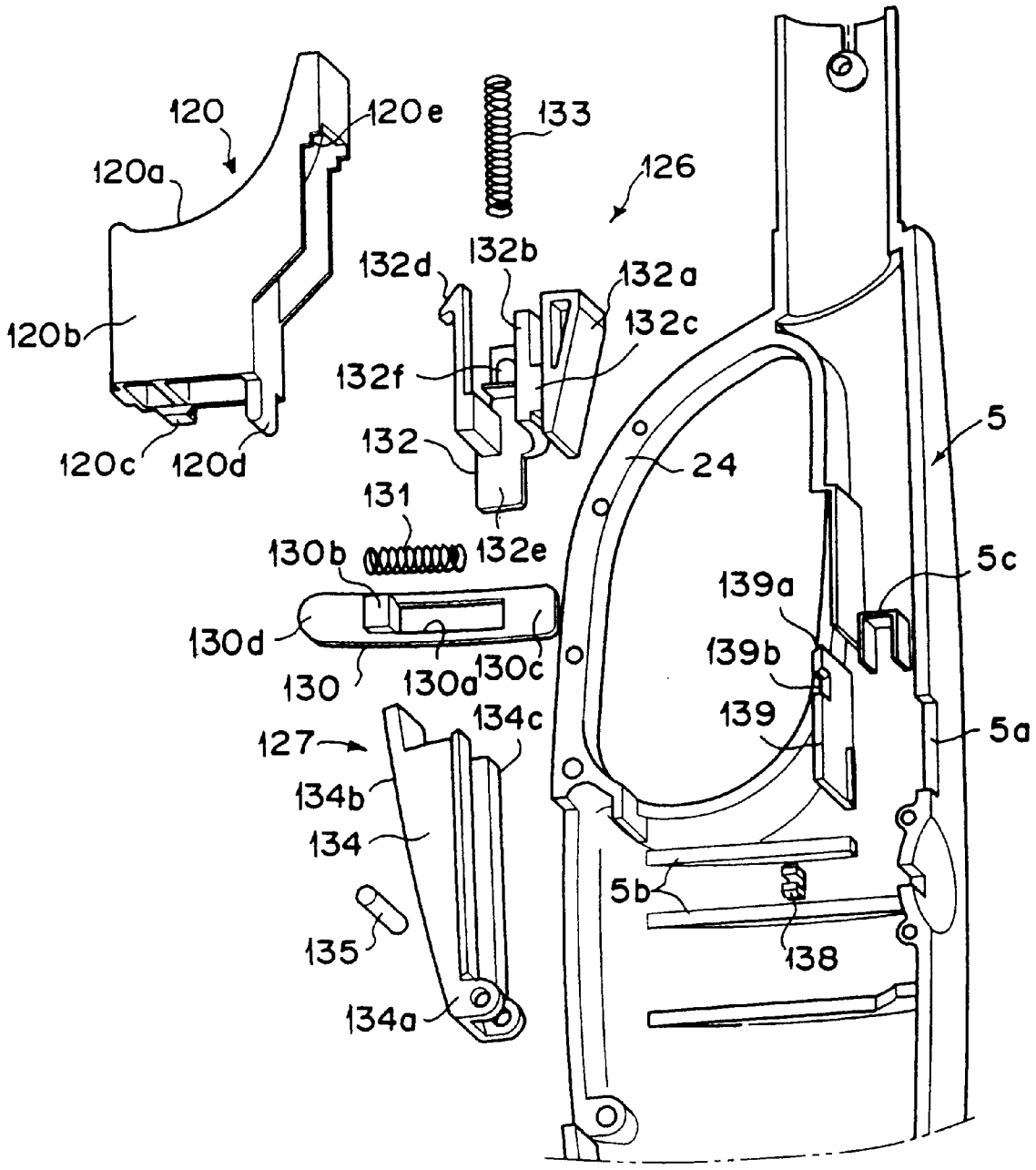
FIG. 14 is an exploded perspective view of FIG. 13.
Figure 15:
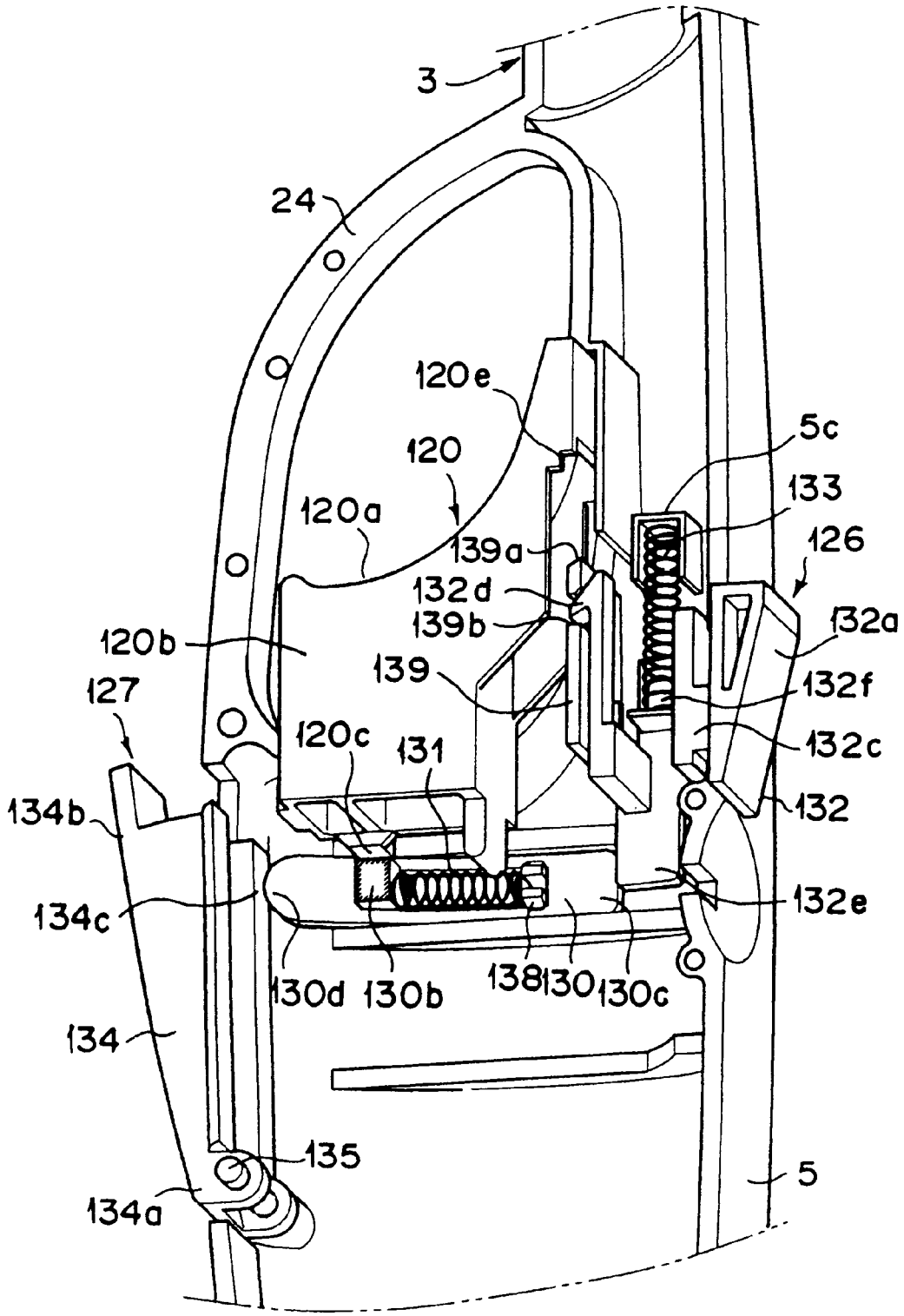
FIG. 15 is a perspective view showing an assembled form of the parts shown in FIG. 13, FIGS. 16A, 16B, 17A, 17B, 18A, and 18B are sectional side views showing the major part of the lighting rod, the views serving as an aid in explaining how the third embodiment of FIG. 12 operates.

How the lighting control mechanism of the lighting rod 101 operates will be described hereinbelow. In FIGS. 13, 15, and 16A, the restraining member 132 is set at the restraining position, the working member 134 is set at the position for the locking (i.e., in the un-operated state), and the operation member 120 is in the un-operated state and is projected toward the guide frame 24. In this state, the locking member 130 is located at the left position for the locking, and the interference projection 130*b* of the locking member 130 is located in front of the abutment projection 120*c* of the operation member 120 and interferes with the abutment projection 120*c*. Therefore, the push-down operation of the operation member 120 cannot be carried out, and the lighting operation cannot be carried out. Also, the abutment section 132*e* of the restraining member 132 projects to the position in front of the other end 130*c* of the locking member 130 and interferes with the other end 130*c*. Therefore, the locking member 130 cannot be moved, and the working member 134, which pushes the end 130*d*, cannot be moved to the position for the lock release.

Figure 16B:
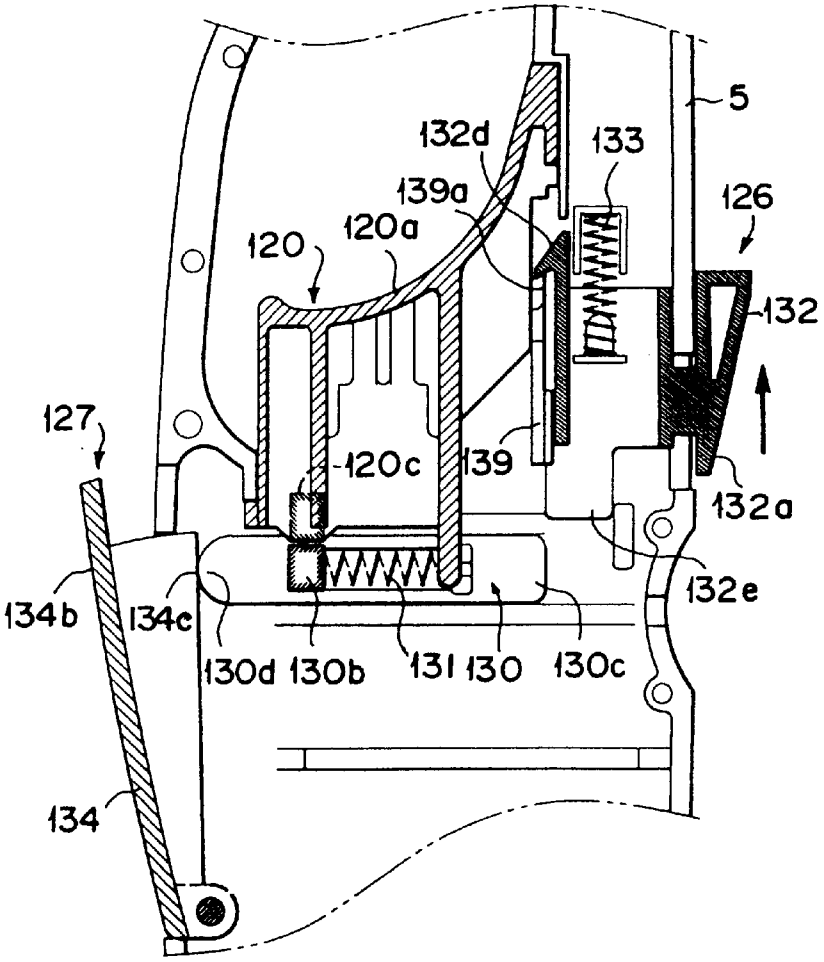
Figure 16A:
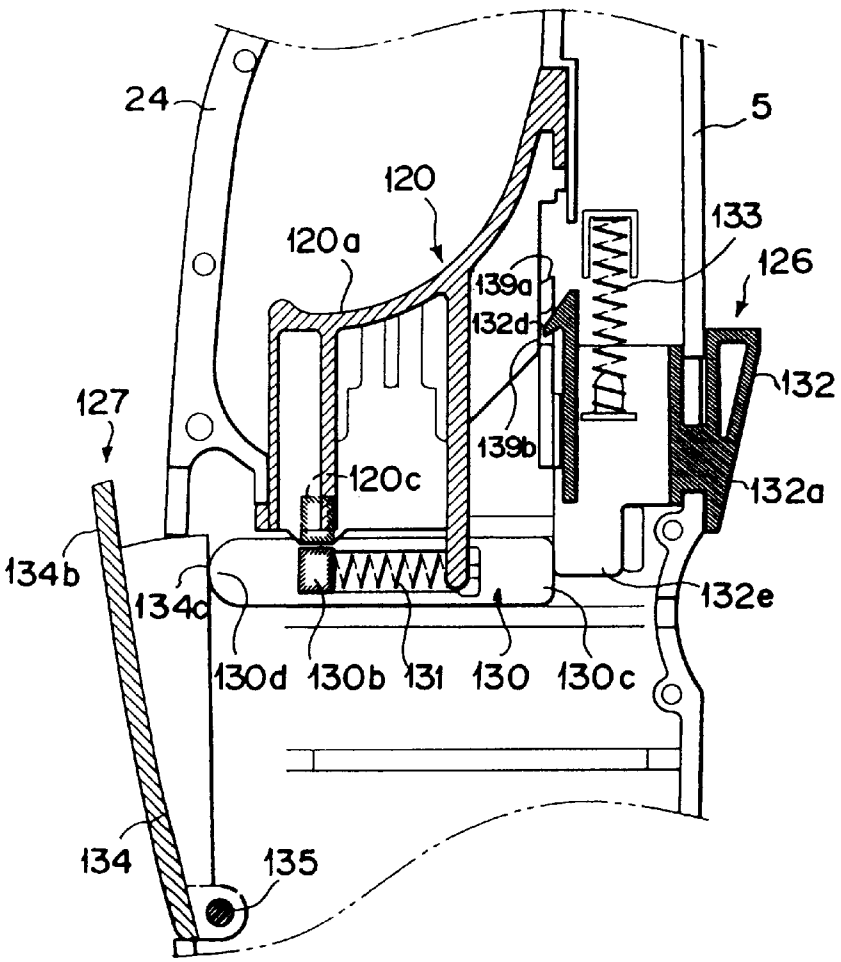

As illustrated in FIG. 16B, when the lighting rod 101 is to be used, the operating section 132*a* of the restraining member 132 is slid to the upper un-restraining position against the urging force of the second resilient member 133. As a result, the restraining member 132 slides, the engagement claw 132*d* engages with the leading end engagement section 139*a* of the wall 139, and the restraining member 132 is thereby retained at the un-restraining position. Also, the abutment section 132*e* of the restraining member 132 moves from the position in front of the locking member 130 to a position that does not interfere with the locking member 130. Therefore, the locking member 130 can be moved toward the position for the lock release.

Figure 17B:
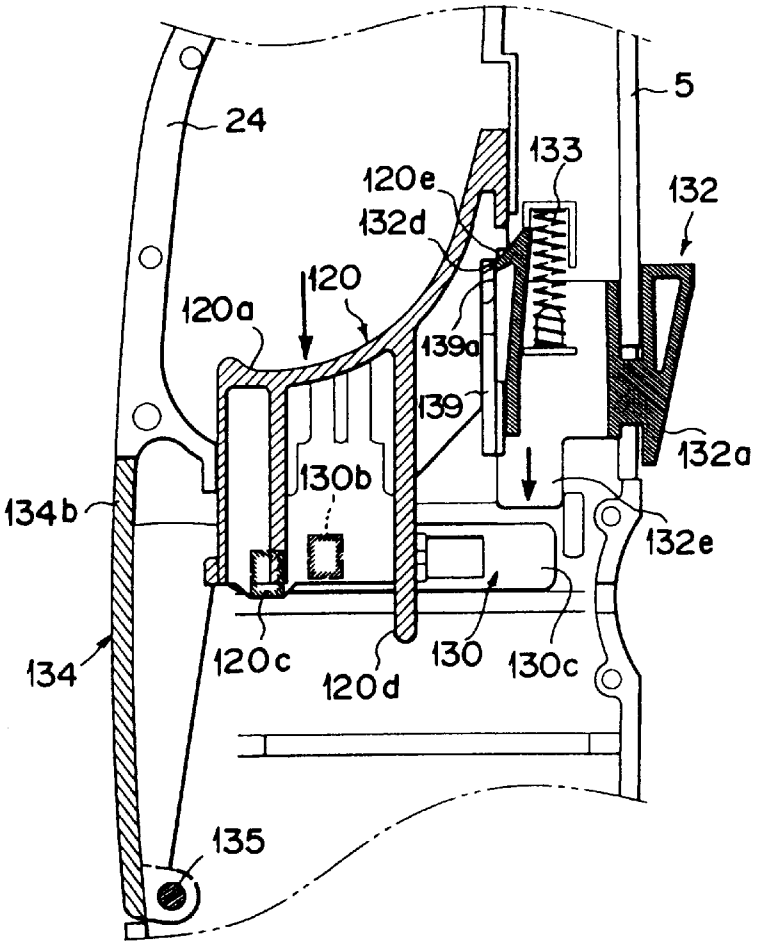
Figure 17A:
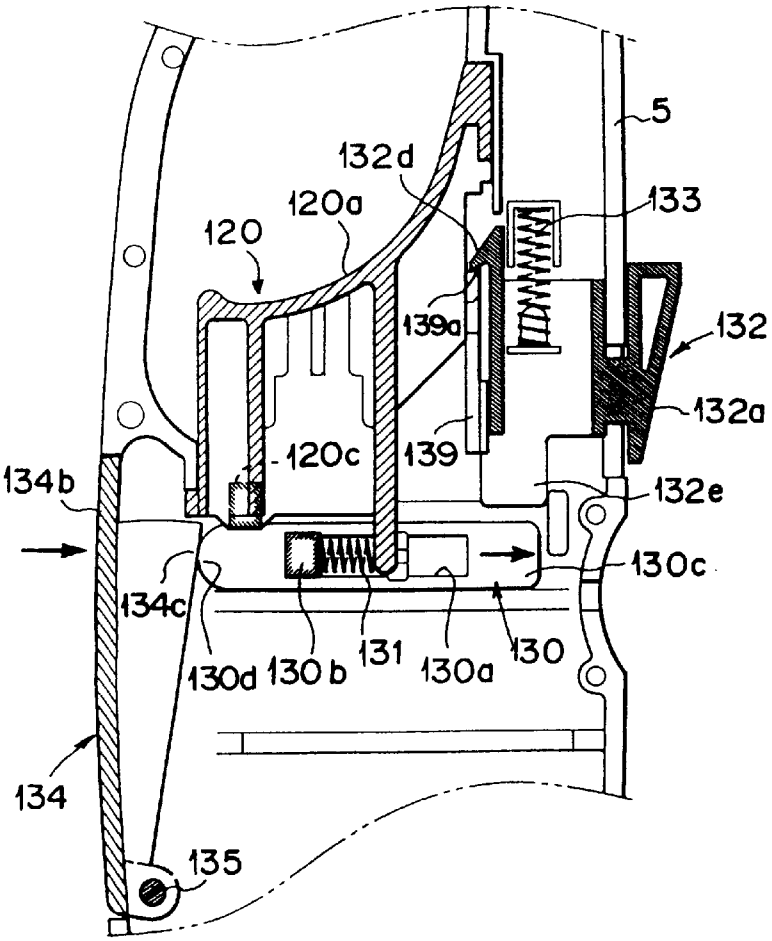

As illustrated in FIG. 17A, when the operating section 134*b* of the working member 134 is pushed into the case housing 5, the pushing section 134*c* of the working member 134 pushes the end 130*d* of the locking member 130 and moves the locking member 130 toward the position for the lock release against the urging force of the first resilient member 131. The interference projection 130*b* of the locking member 130 moves from the position for the interference in front of the abutment projection 120*c* of the operation member 120 to the position for the lock release. Therefore, the operation member 120 can be pushed down, and the lighting operation can be carried out.

When the operation member 120 is thus pushed down for the lighting operation, the leg 120*d* of the operation member 120 pushes the end of the rotatable lever 14 and rotates the rotatable lever 14. As a result, the rotatable lever 14 pulls out the nozzle member 10 and opens the gas flow path in the valve mechanism 8. Therefore, the gas is supplied through the gas pipe 18 to the jetting nozzle. Also, as the operation member 120 is operated in this manner, the piezo-electric unit 22 is caused to generate the discharge voltage (an alternating voltage). The discharge voltage is applied across the electrical discharge electrode, which is located at the extension 3, and the jetting nozzle, and the jetted gas is lighted by the discharge voltage.

Figure 18B:
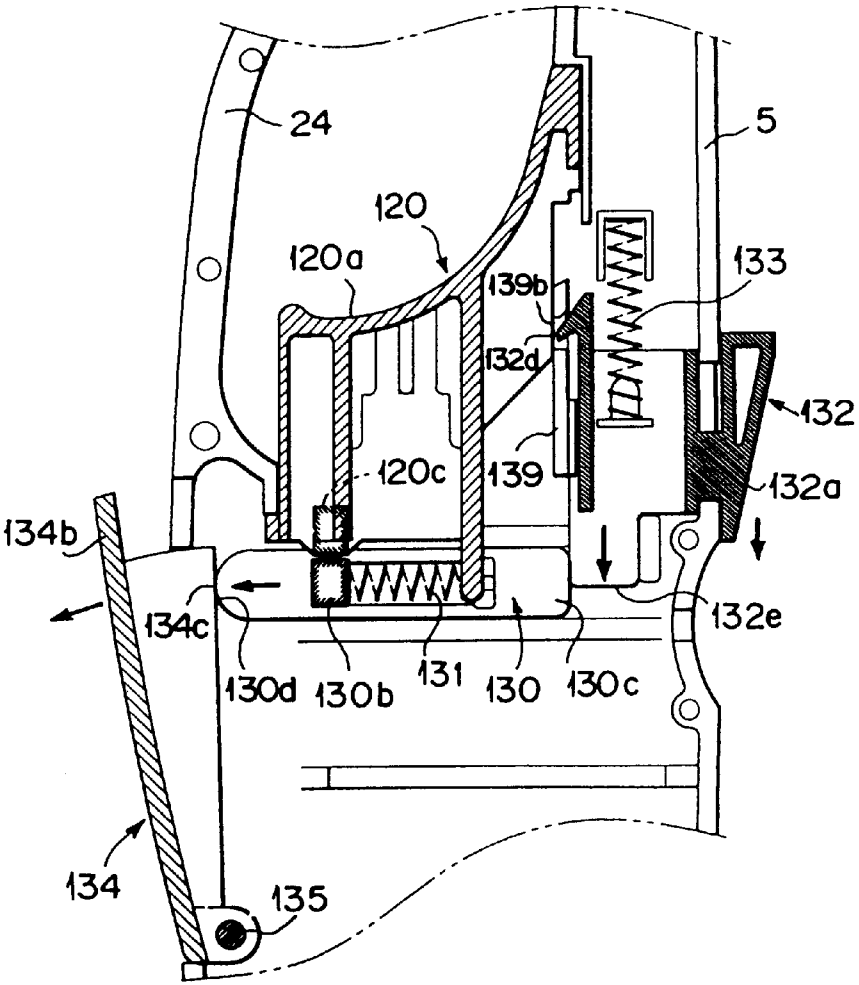
Figure 18A:
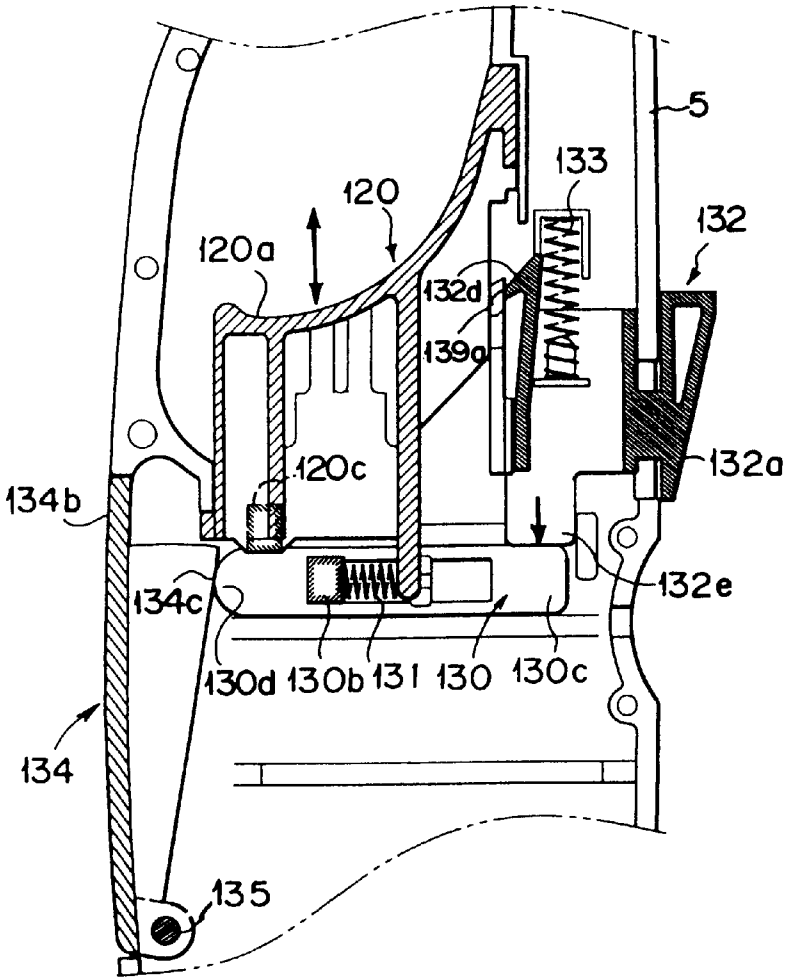

As illustrated in FIG. 17B, when the operation member 120 is pushed down, the retention releasing projection 120*e* of the operation member 120 comes into contact with the oblique surface of the engagement claw 132*d* of the restraining member 132, causes the engagement claw 132*d* to deform resiliently, and thereby disengages the engagement claw 132*d* from the leading end engagement section 139*a*. As a result, the restraining member 132 is moved in the returning direction by the urging force of the second resilient member 133. As illustrated in FIG. 18A, the restraining member 132 is stopped at an intermediate point of the returning movement, at which the abutment section 132*e* formed at the tail end is in contact with the side surface of the other end 130*c* of the locking member 130.

As illustrated in FIG. 18A, with the working member 134 being kept at the position for the lock release by being pushed in continuously, the locking member 130 is retained at the position for the lock release, and the lighting operation with the operation member 120 can be carried out repeatedly.

When the use of the lighting rod 101 is to be finished and the operation member 120 and the working member 134 are released from the pushing force, the operation member 120 is returned to the initial position by the urging force of the spring, which is located in the piezo-electric unit 22. Also, as illustrated in FIG. 18B, the working member 134 is rotated by the resilient force of the first resilient member 131 of the locking member 130 such that the operating section 134*b* may project from the surface of the case housing 5. Also, the locking member 130 moves to the position for the locking, and the interference projection 130*b* moves to the position for the interference with the abutment projection 120*c* of the operation member 120. As the locking member 130 moves in this manner, the restraining member 132 returns to the restraining position. Therefore, the movement of the locking member 130 becomes impossible. In this manner, the locking member 130 automatically returns to the state of the locking shown in FIG. 16A, in which it obstructs the push-down operation of the operation member 120.

Fourth Embodiment

A fourth embodiment of the lighting device in accordance with the present invention, which takes on the form of a lighting rod, will be described hereinbelow with reference to FIGS. 19, 20, 21A, and 21B. In the fourth embodiment, the lighting control mechanism is different from that in the third embodiment, and the basic structure of a lighting rod (i.e., a lighting device) 201 is the same as that of the lighting rod 101 shown in FIG. 12.

In the fourth embodiment, the lighting control mechanism is provided with a locking means 227, which obstructs and locks the lighting operation of the operation member 120 constituted in the same manner as that in the third embodiment, and a restraining means 226, which restrains the operation of the locking means 227. With the lighting control mechanism, when the restraining means 226 is moved from the restraining position to the un-restraining position, the locking means 227 can be moved from the position for the locking to the position for the lock release. At the time at which the locking means 227 has been set at the position for the lock release, successive lighting operations can be carried out with the operation member 120.

The locking means 227 is constituted of a locking member 230, which is supported on the case housing 5 such that it can swing. A restraining member 232, which constitutes the restraining means 226, is located along a side of the locking member 230 and at a position inward from the locking member 230.

A base end 230*c* formed at a lower portion of the locking member 230 of the locking means 227 is supported for rotation on the case housing 5 by a pin 235. The locking member 230 has an operating section 230*d* on the front side, which is to be operated by the user and can be projected from the surface of the case housing 5. The operating section 230*d* can be swung between the position for the locking, which is projected from the surface of the case housing 5, and the position for the lock release, which is flush with the surface of the case housing 5.

The locking member 230 has an inner plate 230*e*, which extends from the operating section 230*d* into the case housing 5, and a block-like locking section 230*a*, which is formed at a side end of an upper portion of the inner plate 230*e*. The locking section 230*a* interferes with the abutment projection 120*c* of the operation member 120 and thereby locks the push-down operation of the operation member 120. Also, a step-like retention releasing section 230*b* is formed at a side end portion of the inner plate 230*e* under the locking section 230*a*. Further, a first resilient member (serving as the first resilient means) 231, which is constituted of a leaf spring, is threaded over the pin 235. The locking member 230 is urged by the urging force of the first resilient member 231 toward position for the locking, at which the operating section 230*d* is projected from the surface of the case housing 5. An inner end portion of the first resilient member 231 is engaged with a projection 5*d*, which is formed on the inner surface of the case housing 5.

When the locking member 230 is set at the position for the locking that is projected from the surface of the case housing 5, the locking section 230*a* of the locking member 230 interferes with the abutment projection 120*c* of the operation member 120 and obstructs the push-down operation of the operation member 120. When the restraining member 232 is set at the un-restraining position, the retention releasing section 230*b* can be brought into contact with a restraining projection 232*b* of the restraining member 232 described below.

Figure 20:
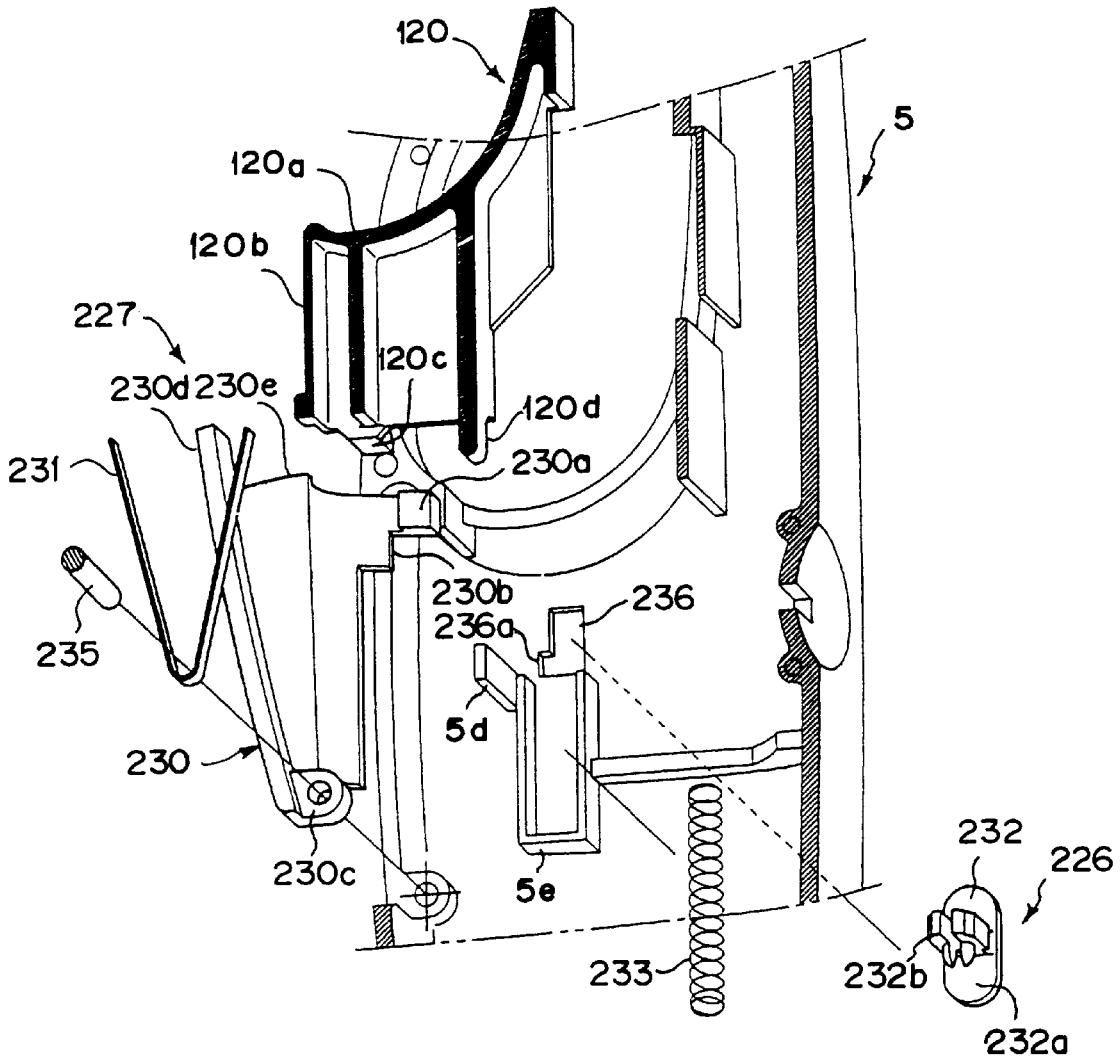
FIG. 20 is an exploded perspective view of FIG. 19, FIGS. 21A and 21B are sectional perspective views showing the major part of the lighting rod, the views serving as an aid in explaining how the fourth embodiment of FIG. 19 operates.

As illustrated in FIG. 20, the restraining member 232 comprises a flat plate-like operating section 232*a* and the restraining projection 232*b*, which is projected from the back surface of the operating section 232*a*. A keyhole-like sliding groove 236 is perforated through the wall of the case housing 5. The restraining member 232 is fitted into the sliding groove 236, such that the operating section 232*a* may be exposed to the outer surface of the case housing 5, and such that the restraining projection 232*b* may be projected to the side inward from the case housing 5. The restraining member 232 can be moved along the sliding groove 236 and vertically between the restraining position on the upper side and the un-restraining position on the lower side. When the restraining member 232 is set at the restraining position, the restraining projection 232*b* of the restraining member 232 is located along the side of the locking section 230*a* of the locking member 230 and restrains the movement of the locking member 230 toward the position for the lock release.

The sliding groove 236 extends in an approximately long groove-like shape from the restraining position at an upper end to the un-restraining position at a lower end. A side of the sliding groove 236 on the side of the un-restraining position continues into a step-like retaining section 236*a*, which serves as the retaining means for retaining the restraining member 232 at the un-restraining position. The retention releasing section (serving as the retention releasing means) 230*b* of the locking member 230 pushes the restraining member 232, which is retained by the retaining section 236*a*, and releases the retention of the restraining member 232. The restraining projection 232*b* of the restraining member 232 is formed such that the head portion may be larger than the width of the sliding groove 236, and such that the base portion may be narrower than the width of the sliding groove 236 and can move in the sliding groove 236.

A spring receiver 5*e* is located on the inner surface of the case housing 5 and at a portion extended downwardly from the sliding groove 236. One end of a second resilient member (serving as the second resilient means) 233, which is constituted of a coiled spring, is secured to the spring receiver 5*e*, and the second resilient member 233 is fitted in a contracted state into the spring receiver 5*e*. The other end of the second resilient member 233 is engaged with the side surface of the restraining projection 232*b* of the restraining member 232. The second resilient member 233 urges the restraining member 232 toward the restraining position.

Figure 19:
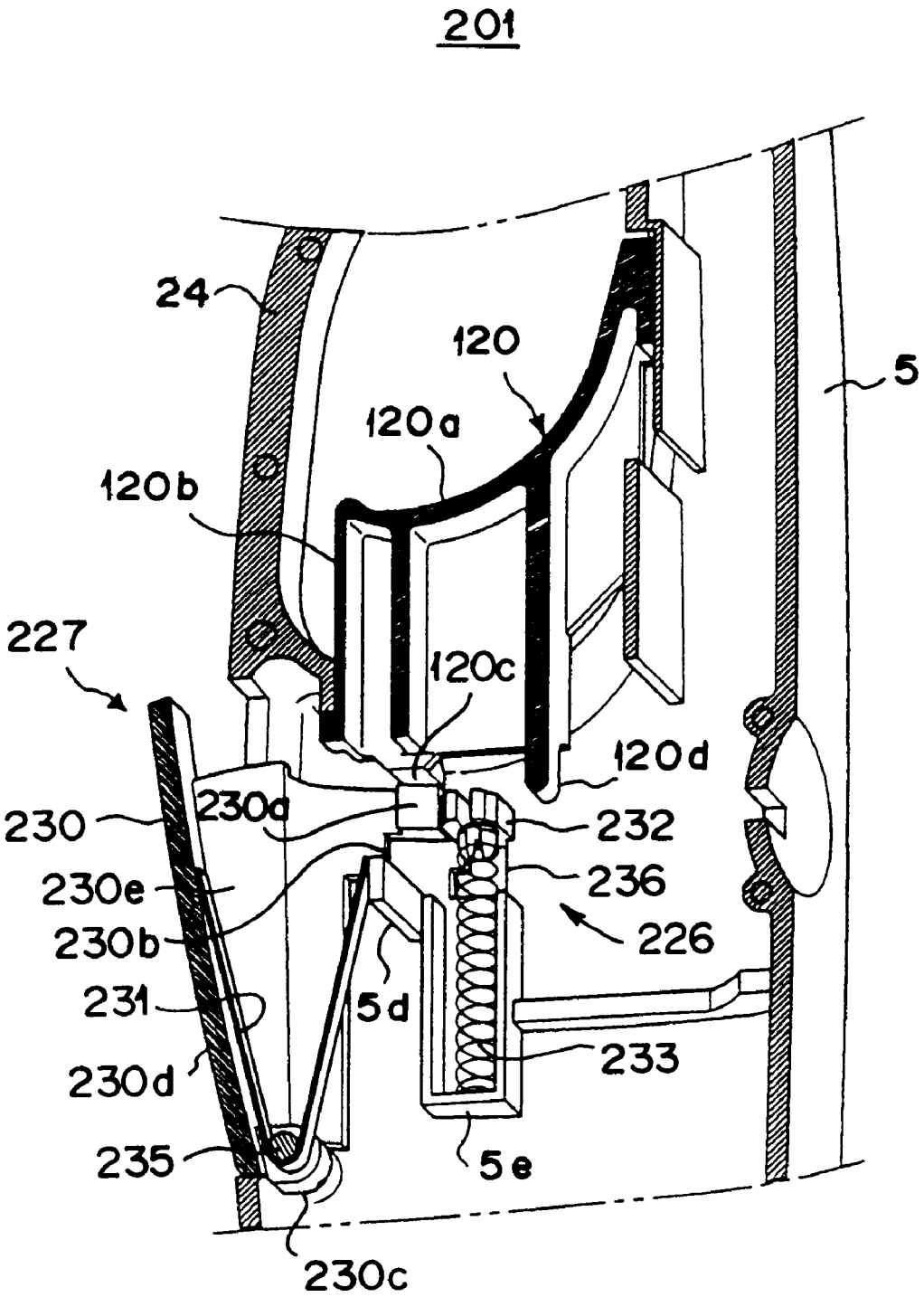
FIG. 19 is a sectional perspective view showing the major part of a lighting control mechanism in a fourth embodiment of the lighting device in accordance with the present invention, which takes on the form of a lighting rod.

How the lighting control mechanism of the lighting rod 201 operates will be described hereinbelow. In FIG. 19, the locking member 230 is set at the position for the locking, the restraining member 232 is set at the restraining position (i.e., in the un-operated state), and the operation member 120 is in the un-operated state and is projected toward the guide frame 24. In this state, the locking member 230 interferes with the operation member 120, and the lighting operation of the operation member 120 cannot be carried out. At this time, the locking section 230*a* of the locking member 230 interferes with the restraining member 232, which is set at the restraining position, and the lock releasing operation cannot be carried out.

Figure 21B:
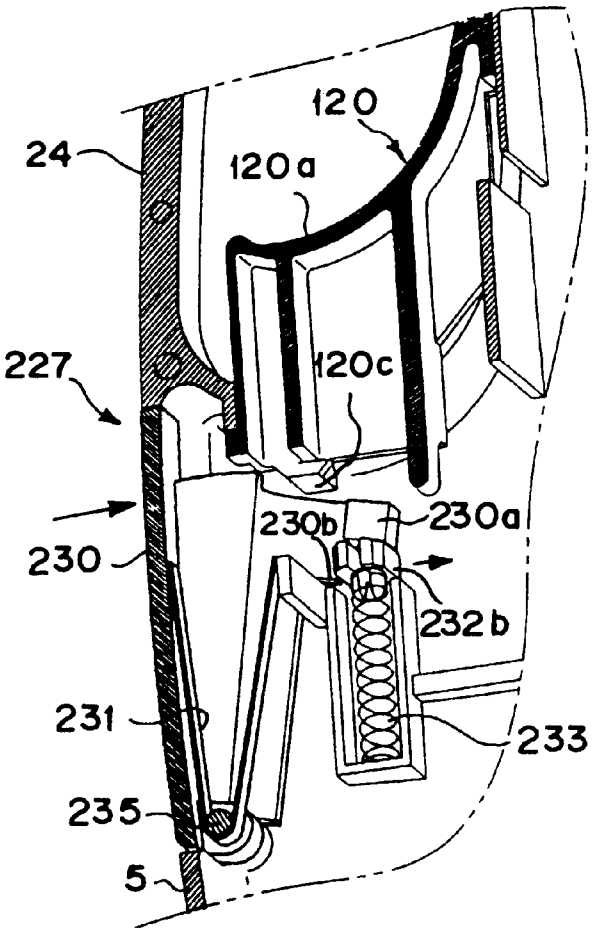
Figure 21A:
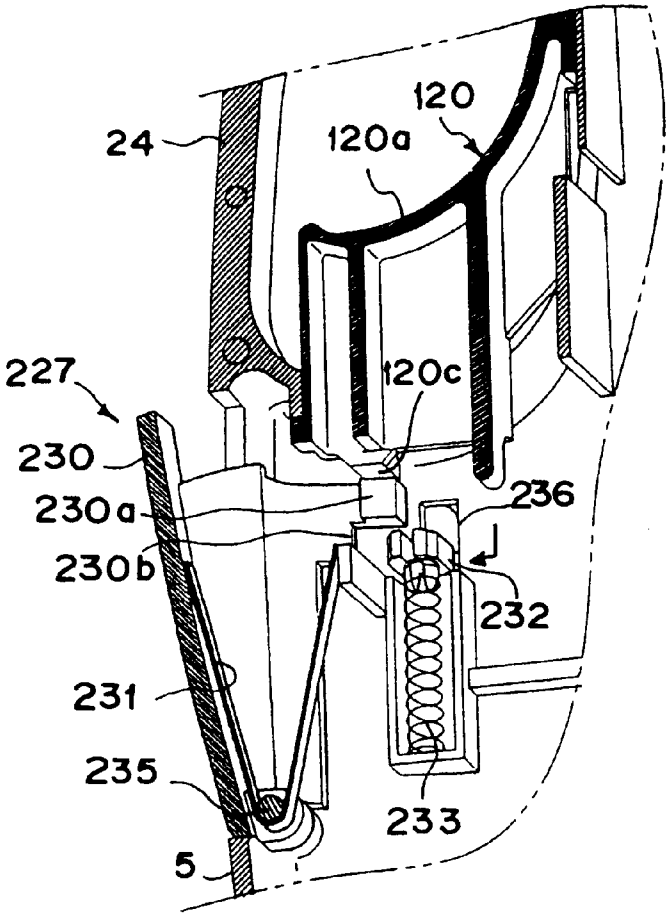

As illustrated in FIG. 21A, when the lighting rod 201 is to be used, the operating section 232*a* of the restraining member 232 is slid to the lower un-restraining position against the urging force of the second resilient member 233. As a result, the restraining member 232 slides along the sliding groove 236 and is engaged with the retaining section 236*a*, which is formed at the end of the sliding groove 236. In this manner, the restraining member 232 is retained at the un-restraining position. As the restraining member 232 moves to the un-restraining position, the movement of the locking member 230 becomes possible, and the locking member 230 is allowed to move toward the position for the lock release.

As illustrated in FIG. 21B, when the operating section 230*d* of the locking member 230 is pushed into the case housing 5 against the urging force of the first resilient member 231, the locking section 230*a* moves from the position for the interference with the abutment projection 120*c* of the operation member 120 to the position for the lock release. Therefore, the operation member 120 can be pushed down, and the lighting operation can be carried out.

As the locking member 230 is pushed into the case housing 5, the retention releasing section 230*b* of the locking member 230 comes into contact with the restraining projection 232*b* of the restraining member 232, causes the restraining projection 232*b* to move, and thereby disengage the restraining projection 232*b* from the retaining section 236*a* of the sliding groove 236. As a result, the restraining member 232 is allowed to move in the upward returning direction by the urging force of the second resilient member 233. However, at this time, the restraining projection 232*b* comes into contact with the lower surface of the locking section 230*a* and stops at an intermediate point of the returning movement.

As illustrated in FIG. 21B, with the locking member 230 being kept at the position for the lock release by being pushed in continuously, the lighting operation with the operation member 120 can be carried out repeatedly.

When the locking member 230 is released from the pushing force, the locking member 230 is moved to the position for the locking by the urging force of the first resilient member 231 and automatically returns to the initial state of the locking, in which the locking member 230 obstructs the push-down operation of the operation member 120. Also, the restraining member 232 is moved by the urging force of the second resilient member 233 from the intermediate position of the returning movement to the restraining position at the upper end of the sliding groove 236. In this manner, the restraining member 232 automatically returns to the initial restraining position, at which it restrains the movement of the locking member 230 toward the position for the lock release.

Fifth Embodiment

A fifth embodiment of the lighting device in accordance with the present invention, which takes on the form of a lighting rod, will be described hereinbelow with reference to FIGS. 22, 23A, 23B, 23C, 24A, and 24B. In the fifth embodiment, the operation member and the lighting control mechanism are different from those in the third embodiment, and the basic structure of a lighting rod (i.e., a lighting device) 301 is the same as that of the lighting rod 101 shown in FIG. 12.

In the fifth embodiment, a lighting control mechanism is provided with a locking means 327 constituted of a push-in type of locking member 330, which locks the lighting operation of an operation member 320, and a restraining means 326 constituted of a sliding type of restraining member 332, which restrains the operation of the locking means 327. With the lighting control mechanism, when the restraining member 332 is slid from a restraining position to an un-restraining position in a direction (upward in FIG. 22) reverse to the direction of the lighting operation of the operation member 320 along the outer surface of the case housing 5, and the locking member 330 is then pushed into the case housing 5 and moved from a position for the locking to a position for the lock release, the lighting operation can be carried out with the operation member 320.

As illustrated in FIG. 23A, in this embodiment, the operation member 320 has a box-like section 320*b*, which is supported by the case housing 5 such that it can slide. An operating section 320*a* is obliquely formed at the top end of the box-like section 320*b*. Projections 320*c*, 320*c* are projected laterally from opposite side surfaces of the box-like section 320*b*. The projections 320*c*, 320*c* come into contact with inner surfaces of the case housing 5 and determines the position to which the operation member 320 is projected. Also, the lower end of the box-like section 320*b* continues into a leg 320*d*, which extends in the direction, along which the box-like section 320*b* slides. A vertical groove 320*e*, which extends along the direction of movement of the operation member 320, is formed in the side surface between the leg 320*d* and the operating section 320*a*. An engagement groove 320*f* is formed at an end of the vertical groove 320*e* and in the direction perpendicularly intersecting with the vertical groove 320*e*.

The locking member 330 of the locking means 327 extends horizontally through the case housing 5 such that the locking member 330 can slide in the direction approximately perpendicularly intersecting with the axial direction of the case housing 5, i.e. with the direction of movement of the operation member 320. As illustrated in FIG. 23B, the locking member 330 is provided with an abutment section 330*c*, which is projected in a key-like shape from both sides of an end of a shaft-like base section 330*b*. The other end of the base section 330*b* is provided with an operating push button 330*a*, which is projected through an opening 5*f* to the exterior of the case housing 5.

Figure 22:
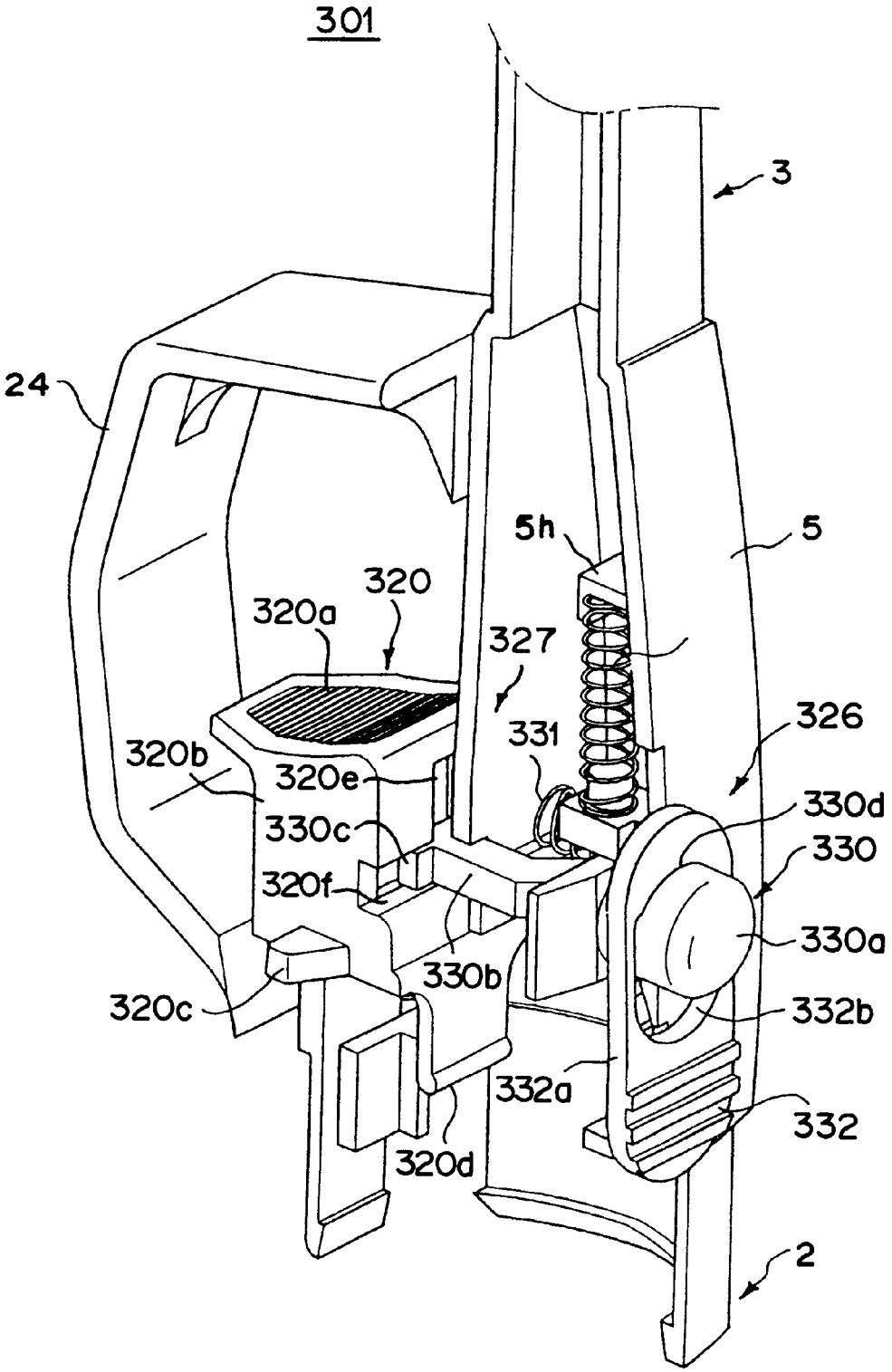
FIG. 22 is a perspective view showing the major part of a lighting control mechanism in a fifth embodiment of the lighting device in accordance with the present invention, which takes on the form of a lighting rod.

The abutment section 330*c* of the locking member 330 can be inserted through a through hole 5*g* of the case housing 5 into the engagement groove 320*f* of the operation member 320 and can thereby interfere with the operation member 320. As illustrated in FIG. 22, when the locking member 330 is set at the position for the locking, the abutment section 330*c* is being engaged with the engagement groove 320*f*. In this state, even if a pushing force is given to the operation member 320, the groove surface of the engagement groove 320*f* is in contact with the surface of the abutment section 330*c*, and the operation member 320 cannot be pushed down. When the operating push button 330*a* is pushed in and the locking member 330 is thereby moved to the position for the lock release, the abutment section 330*c* moves from the engagement groove 320*f* into the operation member 320, and the shaft-like base section 330*b* continuing from the abutment section 330*c* can slide along the vertical groove 320*e* of the operation member 320. Therefore, in this state, the operation member 320 can be moved.

Also, the locking member 330 is provided with a spring receiver 330*e*, which supports one end of a first resilient member (serving as the first resilient means) 331, which is constituted of a coiled spring. The other end of the first resilient member 331 is in contact with the inner surface of the case housing 5. The first resilient member 331 is thus fitted in a contracted form between the spring receiver 330*e* and the inner surface of the case housing 5. The first resilient member 331 urges the locking member 330 toward the position for the locking, at which the operating push button 330*a* is projected from the outer surface of the case housing 5.

A lateral groove-like cutaway portion 330*d* is formed at the base portion of the operating push button 330*a* of the locking member 330. As will be described later, a restraining section 332*c* of the restraining member 332 can be engaged with the cutaway portion 330*d*.

As illustrated in FIG. 23C, the restraining member 332 has a flat plate-like base section 332*a*, which serves as an operating section. An opening 332*b* is formed approximately at the middle portion of the base section 332*a*. The operating push button 330*a* of the locking member 330 is inserted through the opening 332*b*. An upper edge of the opening 332*b* extends in a straight line and forms the restraining section 332*c*, which can engage with the cutaway portion 330*d* of the locking member 330. When the locking member 330 has been pushed into the case housing 5, the head of the operating push button 330*a* is located at a height that can interfere with the restraining section 332*c* of the restraining member 332.

A projection-like spring receiver 332*d* continues from the back surface of the restraining member 332 and is projected into the case housing 5. The spring receiver 332*d* supports one end of a second resilient member (serving as the second resilient means) 333, which is constituted of a coiled spring and urges the restraining member 332 toward the restraining position (i.e., downwardly). The other end of the second resilient member 333 is supported by a spring receiver 5*h*, which is formed on the inner surface of the case housing 5. The second resilient member 333 is thus fitted in a contracted form between the spring receiver 332*d* and the spring receiver 5*h*.

An engagement claw (i.e., a hook) 332*e*, which serves as an un-restraining position retaining means and can deform resiliently, is formed on the back surface of the base section 332*a*. The end of the engagement claw 332*e* has a tapered surface. The end of the engagement claw 332*e* can pass over an oblique surface 5*k* of the case housing 5 and can be engaged with a lower edge of the circular opening 5*f*. Also, an inner end face of the operating push button 330*a* of the locking member 330 can came into contact with the engagement claw 332*e*. When the operating push button 330*a* is pushed into the case housing 5, the operating push button

330*a* deforms the engagement claw 332*e* and disengage the engagement claw 332*e* from the lower edge of the circular opening 5*f*.

A slit groove 5*j*, which extends in the direction of movement of the operation member 320, is perforated through a portion of the wall of the case housing 5, at which the restraining member 332 is located. The slit groove 5*j* extends above and below the circular opening 5*f*, into which the operating push button 330*a* of the locking member 330 is inserted. The spring receiver 332*d* and the engagement claw 332*e* of the restraining member 332 are inserted to the side more inward than the slit groove 5*j*. In this manner, the restraining member 332 is supported such that it can slide between the lower restraining position and the upper un-restraining position and in parallel with the direction of movement of the operation member 320.

How the lighting control mechanism of the lighting rod 301 operates will be described hereinbelow. In FIG. 22, the restraining member 332 is set at the initial position (i.e., the restraining position) that is retreated by the second resilient member 333, and the locking member 330 is set at the position for the locking by the urging force of the first resilient member 331. In this state, the abutment section 330*c* of the locking member 330 is located in the engagement groove 320*f* of the operation member 320 and obstructs the push-down operation of the operation member 320. Therefore, the lighting operation cannot be carried out.

At this time, the restraining section 332*c* of the restraining member 332 is inserted into and engaged with the cutaway portion 330*d* of the operating push button 330*a* of the locking member 330. Therefore, the locking member 330 cannot be pushed in and moved to the position for the lock release, and the state of the locking of the lighting operation is kept.

Figure 24B:
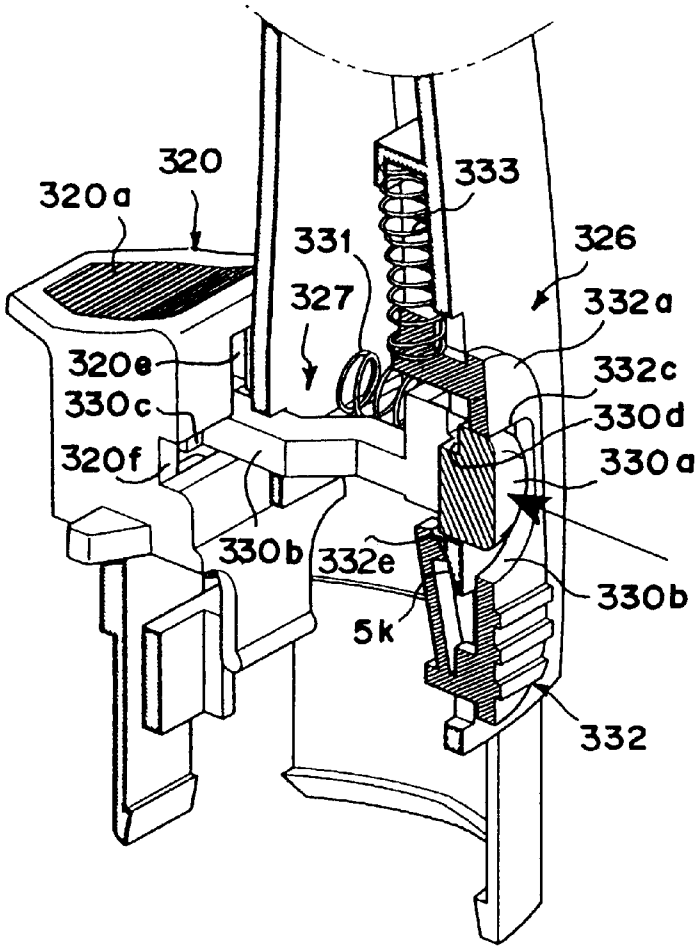
Figure 24A:
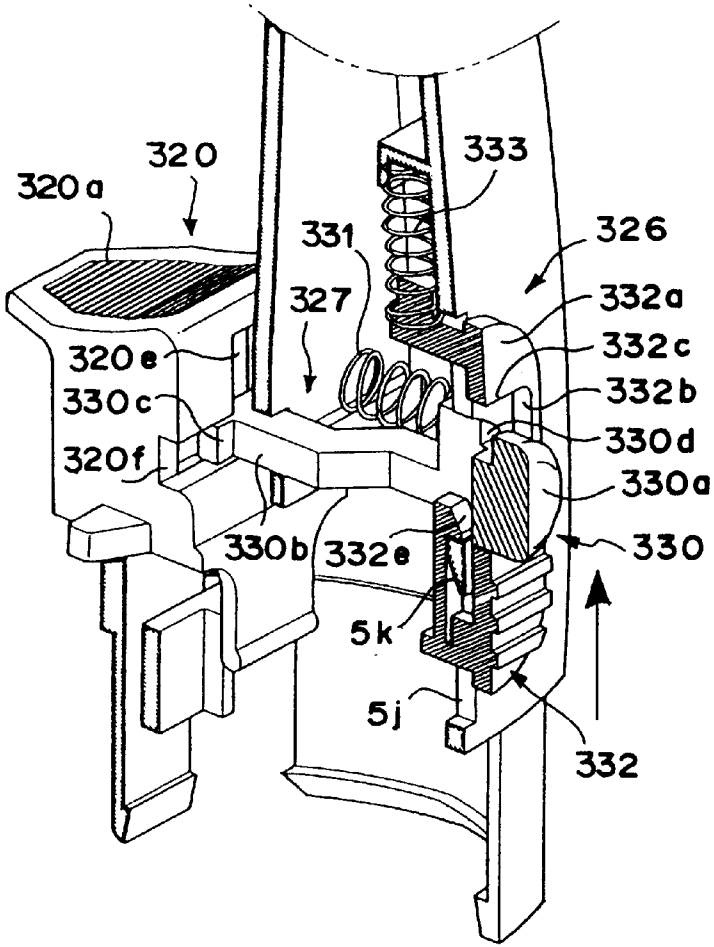

As illustrated in FIG. 24A, when the lighting rod 301 is to be used, the restraining member 332 is slid upwardly against the urging force of the second resilient member 333. The restraining member 332 slides to the upper end of the movement, and the engagement claw 332*e* of the restraining member 332 passes over the oblique surface 5*k* of the case housing 5 by deforming resiliently and is engaged with the lower edge of the opening 5*f*. The restraining member 332 is thus retained at the un-restraining position. As the restraining member 332 is moved from the restraining position to the un-restraining position, the restraining section 332*c* of the restraining member 332 disengages from the cutaway portion 330*d* of the locking member 330. Therefore, the locking member 330 can be pushed in toward the position for the lock release.

As illustrated in FIG. 24B, the locking member 330 is pushed in toward the operation member 320 against the urging force of the first resilient member 331 and is thereby moved from the position for the locking to the position for the lock release. As a result, the abutment section 330*c* of the locking member 330 disengages from the engagement groove 320*f* of the operation member 320.

While the locking member 330 is being pushed in and set at the position for the lock release, the lighting operation is carried out with the operation member 320. With the locking member 330 being kept at the position for the lock release by being pushed in continuously, the lighting operation with the operation member 320 can be carried out repeatedly.

When the locking member 330 is pushed into the case housing 5, the inner end face of the operating push button 330*a* comes into contact with the engagement claw 332*e* of the restraining member 332, causes the engagement claw 332*e* to deform resiliently, and releases the retention of the engagement claw 332*e* at the opening 5*f*, i.e. the retention of the restraining member 332 at the un-restraining position.

After the restraining member 332 is released from the retention at the un-restraining position, the restraining member 332 begins retreating to the restraining position by the urging force of the second resilient member 333. However, at this time, the restraining section 332*c* of the restraining member 332 comes into contact with the side surface of the head of the operating push button 330*a* of the locking member 330. Therefore, the restraining member 332 is retained at the intermediate point of the returning movement.

When the use of the lighting rod 301 is to be finished and the operation member 320 and the locking member 330 are released from the pushing force, the operation member 320 is returned to the initial position. Also, the locking member 330 is moved by the urging force of the first resilient member 331 to the position that is projected from the outer surface of the case housing 5. As a result, the abutment section 330*c* of the locking member 330 is inserted into the engagement groove 320*f* of the operation member 320. In this manner, the locking member 330 automatically returns to the initial position for the locking.

As the locking member 330 returns to the position for the locking, the restraining member 332 retreats from the intermediate point of the returning movement by the urging force of the second resilient member 333. Also, the restraining section 332*c* of the restraining member 332 is inserted into and engaged with the cutaway portion 330*d* of the operating push button 330*a*. In this manner, the restraining member 332 automatically returns to the initial restraining position.

Sixth Embodiment

A sixth embodiment of the lighting device in accordance with the present invention, which takes on the form of a lighting rod, will be described hereinbelow with reference to FIGS. 25, 26, 27A, and 27B. In the sixth embodiment, the operation member and the lighting control mechanism are different from those in the third embodiment, and the basic structure of a lighting rod (i.e., a lighting device) 401 is the same as that of the lighting rod 101 shown in FIG. 12.

In the sixth embodiment, a lighting control mechanism is approximately similar to that in the fifth embodiment. The lighting control mechanism is provided with a locking means 427 constituted of a push-in type of locking member 430, which locks the lighting operation of the operation member 320, and a restraining means 426 constituted of a sliding type of restraining member 432, which restrains the operation of the locking means 427. With the lighting control mechanism, when the restraining member 432 is slid from a restraining position to an un-restraining position in a direction (upward in FIG. 25) reverse to the direction of the lighting operation of the operation member 320 along the outer surface of the case housing 5, and the locking member 430 is then pushed into the case housing 5 and moved from a position for the locking to a position for the lock release, the lighting operation can be carried out with the operation member 320.

As in the fifth embodiment, the operation member 320 is provided with the vertical groove 320*e* and the engagement groove 320*f*, which are formed in the side surface of the box-like section 320*b*.

The locking member 430 of the locking means 427 extends horizontally through the case housing 5 such that the locking member 430 can slide in the direction intersecting with the direction of movement of the operation member 320. The locking member 430 is provided with an abutment section 430*c*, which is projected in a key-like shape from both sides of an end of a shaft-like base section 430*b*. The other end of the base section 430*b* is provided with a disk-like operating push button 430*a* via a shaft 430*d*, which has a laterally long elliptic cross-sectional shape and slides in the opening 5*f* of the case housing 5. The operating push button 430*a* is projected to the exterior of the case housing 5.

As in the fifth embodiment, the abutment section 430*c* of the locking member 430 can be inserted through a through hole 5*g* of the case housing 5 into the engagement groove 320*f* of the operation member 320 and can thereby interfere with the operation member 320. The abutment section 430*c* thereby obstructs and locks the push-down operation of the operation member 320. When the locking member 430 is pushed into the operation member 320, the shaft-like base section 430*b* can slide along the vertical groove 320*e* of the operation member 320. Therefore, in this state, the lighting operation can be carried out with the operation member 320.

Also, the locking member 430 is provided with a spring receiver 430*e*, which supports one end of a resilient member 431, which is constituted of a coiled spring. The resilient member 431, which is thus fitted in a contracted form, urges the locking member 430 toward the position for the locking.

A projection 430*f* is formed at an upper portion of the outer circumference of the shaft 430*d*, which is formed at the base portion of the operating push button 430*a* of the locking member 430. As will be described later, the projection 430*f* can interfere with a restraining section 432*c* of the restraining member 432. Also, an oblique surface 430*g* is formed at a lower part on the side opposite to the projection 430*f*. The oblique surface 430*g* is inclined from the lower end portion of the operating push button 430*a* to the bottom of the shaft 430*d*.

The restraining member 432 has a flat plate-like base section 432*a*, which serves as an operating section. An opening 432*b*, into which the shaft 430*d* of the locking member 430 is inserted, is formed approximately at the middle portion of the base section 432*a*. The opening 432*b* has a cocoon-like shape, which is vertically long, and projections 432*d*, 432*d* are formed on opposite side edges at a middle portion of the opening 432*b*. Also, a slit 432*e*, which continues into the opening 432*b*, is formed at the upper end portion of the base section 432*a*, such that the upper end portion of the base section 432*a* may be split by the slit 432*e*. The split portions at the upper end of the opening 432*b* can deform resiliently such that they may open horizontally. The surface portions on both sides of the slit 430*e* serve as a restraining section 432*c*, which can come into contact with the end face of the projection 430*f* of the locking member 430.

The projections 432*d*, 432*d*, which are formed on opposite side edges of the opening 432*b* of the restraining member 432, serve as the retaining means. The projections 432*d*, 432*d* are projected such that the distance between them may be shorter than the width of the shaft 430*d* of the locking member 430. When the slit 430*e* is deformed so as to open, the projections 432*d*, 432*d* can pass over the shaft 430*d*. When the restraining member 432 is moved from the restraining position to the un-restraining position such that the projections 432*d*, 432*d* may pass over the shaft 430*d*, the lower edge of the opening 432*b* comes into contact with the oblique surface (serving as the retention releasing means) 430*g* of the locking member 430.

Guiding members 51, 51, which extend vertically, are formed at the portion of the case housing 5, at which there straining member 432 is located. The guiding members 51, 51 are located on both sides of the opening 5*f*, into which the shaft 430*d* of the locking member 430 is inserted. Opposite side portions of the restraining member 432 are guided by the guiding members 51, 51, and the restraining member 432 is thereby supported such that it can slide between the lower restraining position and the upper un-restraining position.

Figure 25:
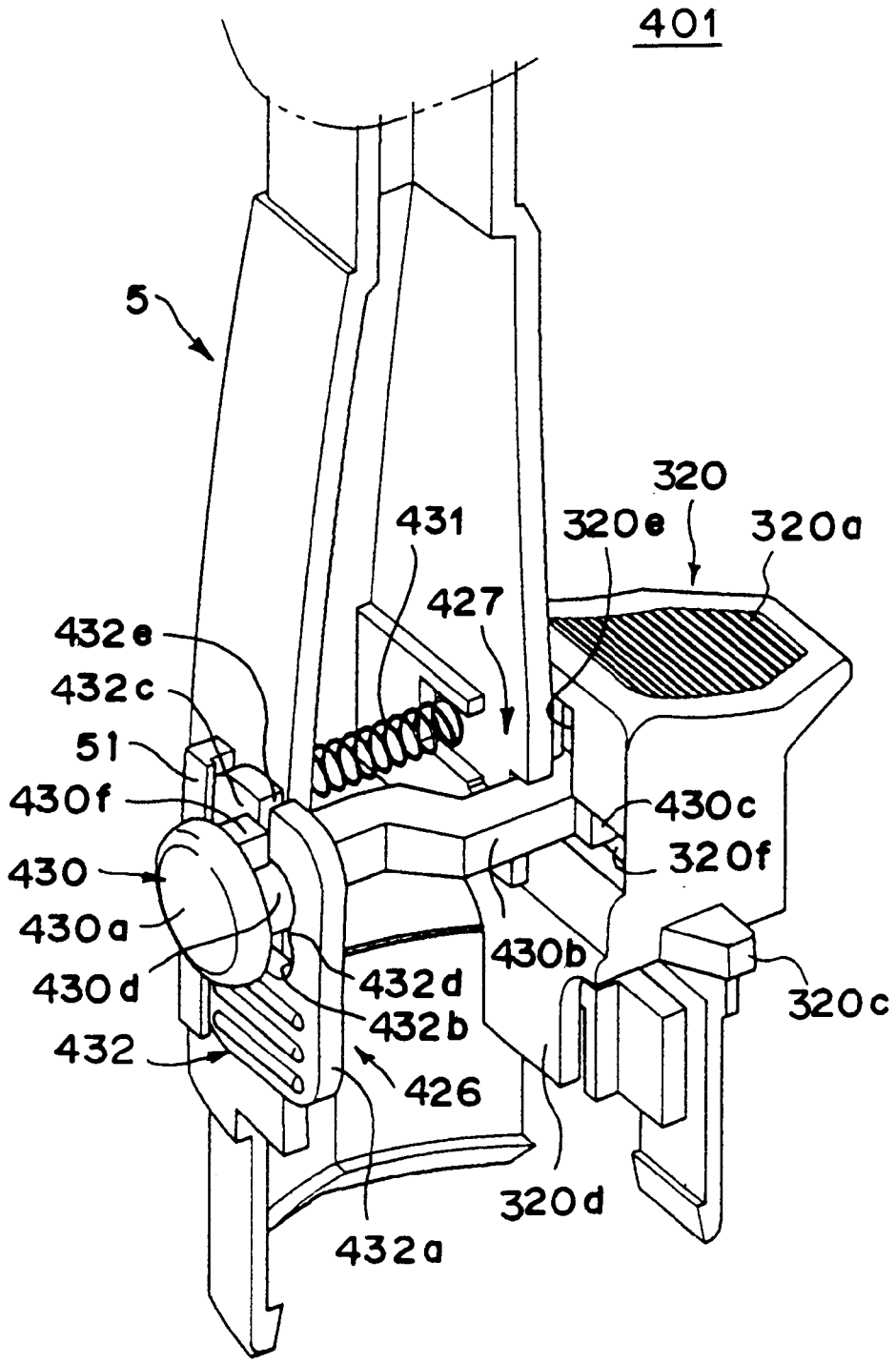
FIG. 25 is a perspective view showing the major part of a lighting control mechanism in a sixth embodiment of the lighting device in accordance with the present invention, which takes on the form of a lighting rod.
Figure 26:
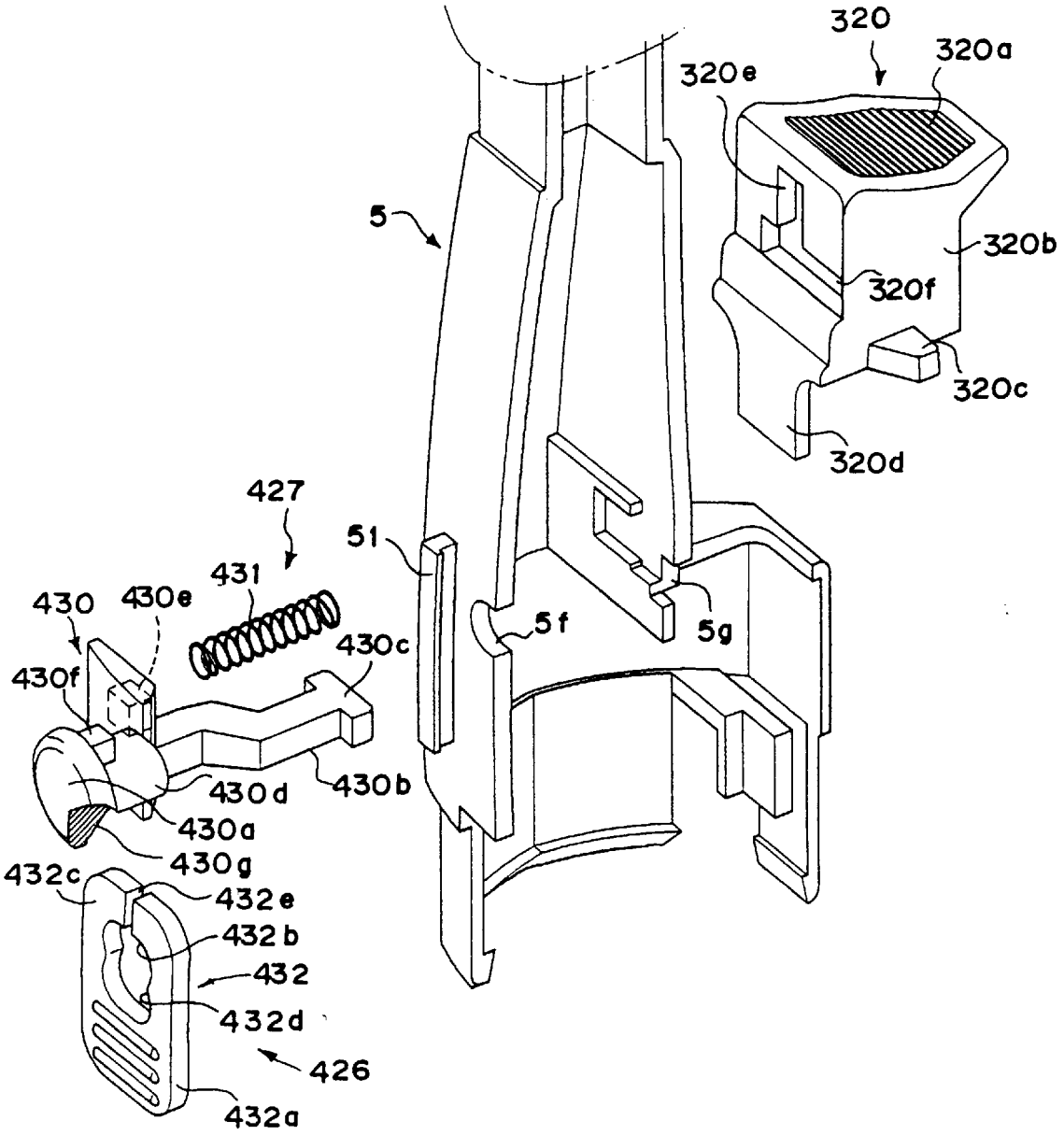
FIG. 26 is an exploded perspective view of FIG. 25, and FIGS. 27A and 27B are sectional perspective views showing the major part of the lighting rod, the views serving as an aid in explaining how the sixth embodiment of FIG. 25 operates.

How the lighting control mechanism of the lighting rod 401 operates will be described hereinbelow. In FIG. 25, the restraining member 432 is set at the initial position (i.e., the restraining position), and the locking member 430 is set at the position for the locking. In this state, the abutment section 430*c* of the locking member 430 is located in the engagement groove 320*f* of the operation member 320 and obstructs the movement of the operation member 320. Therefore, the lighting operation cannot be carried out.

At this time, the projection 430*f* of the locking member 430 is in contact with and interferes with the restraining section 432*c* of the restraining member 432. Therefore, the locking member 430 cannot be pushed in and moved to the position for the lock release, and the state of the locking of the lighting operation is kept.

Figure 27B:
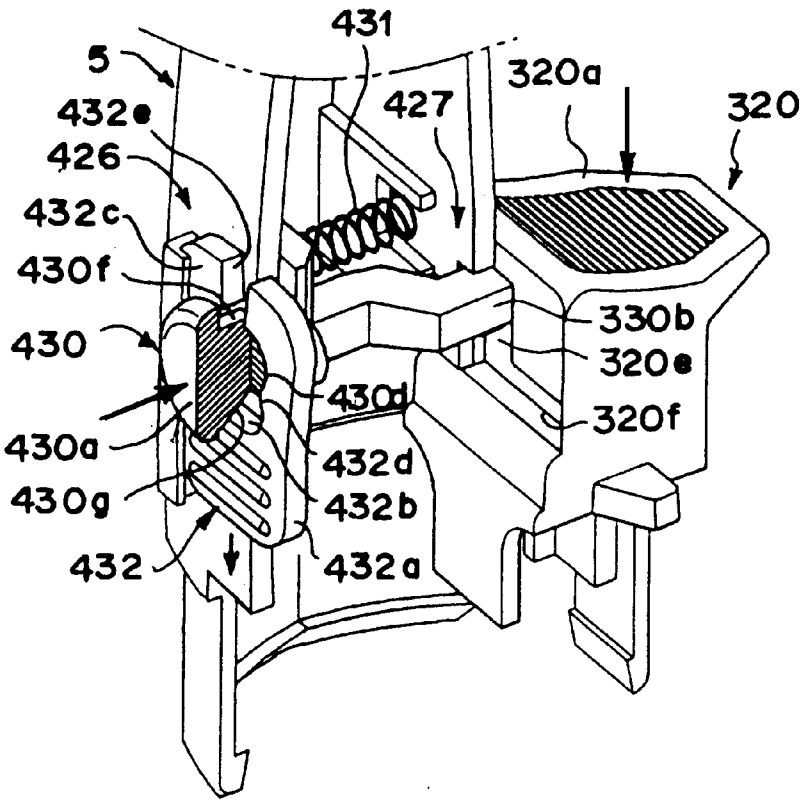
Figure 27A:
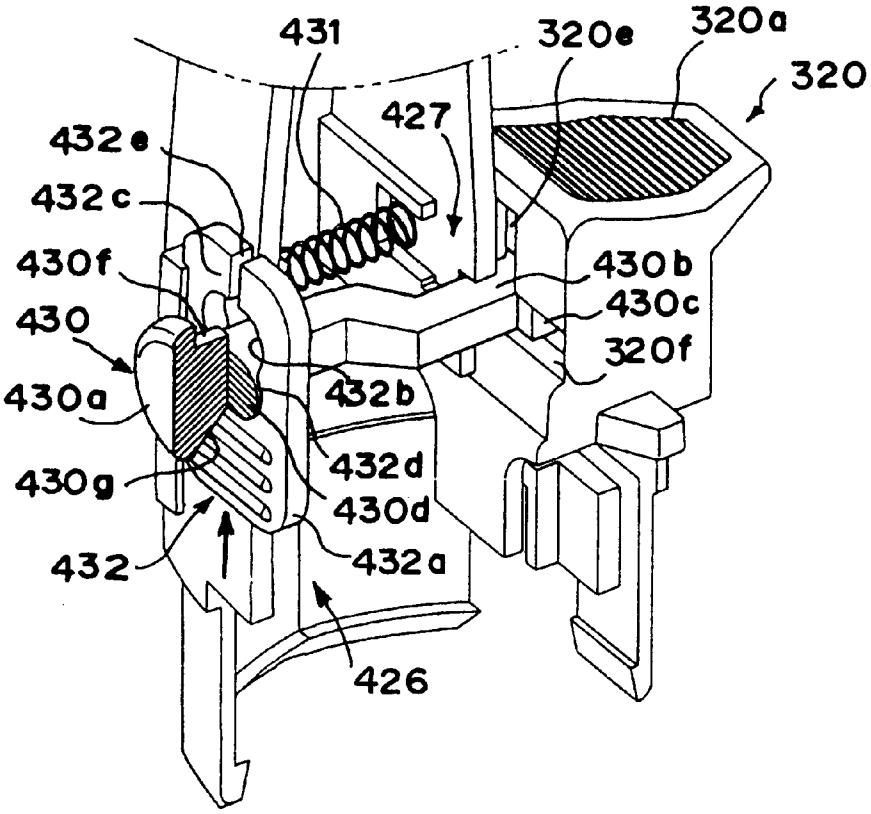

As illustrated in FIG. 27A, when the lighting rod 401 is to be used, the restraining member 432 is pushed upwardly. As a result, the projections 432*d*, 432*d* of the opening 432*b* come into contact with the outer circumference of the shaft 430*d*, and the restraining member 432 is deformed resiliently such that the slit 430*e* may open. Also, the projections 432*d*, 432*d* pass over the shaft 430*d*, and the lower edge of the opening 432*b* fits onto the shaft 430*d*. The restraining member 432 thus slides to the upper end of the movement, and the projections 432*d*, 432*d* grasp the shaft 430*d* by the resilient force. The restraining member 432 is thus retained at the un-restraining position.

As the restraining member 432 is moved from the restraining position to the un-restraining position, the restraining section 432*c* of the restraining member 432 moves from the position in front of the projection 430*f*, and the projection 430*f* stands facing the space defined by the opening 432*b*. Therefore, the locking member 430 can be pushed in toward the position for the lock release.

As illustrated in FIG. 27B, the locking member 430 is pushed in toward the position for the lock release against the urging force of the resilient member 431. As a result, the abutment section 430*c* of the locking member 430 disengages from the engagement groove 320*f* of the operation member 320. In this state, the lighting operation can be carried out with the operation member 320. Also, with the locking member 430 being kept at the position for the lock release by being pushed in continuously, the lighting operation with the operation member 320 can be carried out repeatedly.

When the locking member 430 is pushed into the case housing 5, the oblique surface 430*g*, which is formed at the lower end of the operating push button 430*a*, comes into contact with the lower edge of the opening 432*b* of the restraining member 432 and causes the restraining member 432 to move down. When the locking member 430 has been pushed in completely, the restraining member 432 is moved down to a position, at which the projections 432*d*, 432*d* of the opening 432*b* have passed over the vertexes of the shaft 430*d*. Therefore, the restraining member 432 is released from the retention at the un-restraining position.

After the restraining member 432 is released from the retention at the un-restraining position, the projections 432*d*, 432*d* are caused by the resilient force of the restraining member 432 to move down along the circumferential surface of the shaft 430*d*, and the restraining member 432 is thus caused to retreat toward the restraining position.

However, at this time, the lower surface of the restraining section 432*c* of the restraining member 432 comes into contact with the upper surface of the projection 430*f* of the locking member 430. Therefore, the restraining member 432 is retained at the intermediate point of the returning movement.

When the use of the lighting rod 401 is to be finished and the operation member 320 and the locking member 430 are released from the pushing force, the operation member 320 is returned to the initial position. Also, the locking member 430 is moved by the urging force of the resilient member 431 to the position that is projected from the outer surface of the case housing 5. Thus the locking member 430 automatically returns to the initial position for the locking. Also, the projection 430*f* of the locking member 430 moves to the side outward from the restraining member 432. As a result, the restraining member 432, which has been retained at the intermediate point of the returning movement, moves down by its resilient force, and the restraining section 432*c* of the restraining member 432 is located in front of the projection 430*f*. In this manner, the restraining member 432 automatically returns to the initial restraining position.

In the third, fourth, fifth, and sixth embodiments described above, the retaining means is employed in order to retain the restraining means at the un-restraining position. However, after the locking means is moved to the position for the lock release while the restraining means is being set at the un-restraining position, it becomes unnecessary for the retaining means to work in order to retain the restraining means at the un-restraining position. Therefore, the retaining means may be omitted.

What is claimed is:

1. A lighting device, comprising:

i) a jetting nozzle for jetting out a gas, ii) a gas tank, iii) a valve mechanism for opening and closing a path, through which the gas is supplied from the gas tank to the jetting nozzle, iv) a piezo-electric unit for generating a discharge voltage for lighting the gas, and v) an operation member, which is capable of sliding and drives the valve mechanism and the piezo-electric unit in order to carry out a lighting operation, wherein the improvement comprises the provision of:

a) a locking means, which is capable of moving between a position for locking and a position for lock release, said locking means working such that, when said locking means is set at the position for the locking, said locking means may lock the lighting operation of the operation member, and such that, when said locking means is set at the position for the lock release, said locking means may allow a single lighting operation of the operation member, and b) a restraining means, which allows successive lighting operations of the operation member when said locking means is moved to the position for the lock release.

2. A lighting device as defined in claim 1 wherein said locking means works such that, when said locking means is set at the position for the lock release, said locking means may allow the lighting operation of the operation member, and such that said locking means may automatically return to the position for the locking, accompanying the lighting operation of the operation member.

3. A lighting device as defined in claim 1 wherein the lighting device is provided with a retaining means, which retains said locking means at the position for the lock release, and a retention releasing means, which releases said locking means from the retention by said retaining means, said releasing being carried out in association with the lighting operation.

4. A lighting device as defined in claim 3 wherein said restraining means works such that, when said restraining means is set at an un-restraining position in a non-working state, said restraining means may allow the returning movement of said locking means, which has been released by said retention releasing means, to the position for the locking, such that, when said restraining means is set at a restraining position in a working state, said restraining means may cause the returning movement of said locking means, which has been released by said retention releasing means, to the position for the locking to be obstructed at an intermediate point of the returning movement, and such that, when said restraining means is set from the restraining position to the un-restraining position, said restraining means may cause said locking means to move from the intermediate point of the returning movement to the position for the locking.

5. A lighting device, comprising:

i) a jetting nozzle for jetting out a gas, ii) a gas tank, iii) a valve mechanism for opening and closing a path, through which the gas is supplied from the gas tank to the jetting nozzle, iv) a piezo-electric unit for generating a discharge voltage for lighting the gas, and v) an operation member, which is capable of sliding and drives the valve mechanism and the piezo-electric unit in order to carry out a lighting operation, wherein the improvement comprises the provision of:

a) a locking means, which locks the operation member and is located at an outer surface of the lighting device, and b) a restraining means, which restrains said locking means and is located at the outer surface of the lighting device, said restraining means working such that, when said restraining means is set from a restraining position to an un-restraining position, said restraining means may enable said locking means to undergo a lock releasing operation by being set from a position for the locking to a position for the lock release and may allow the lighting operation of the operation member.

6. A lighting device as defined in claim 5 wherein said locking means works such that, when the lock releasing operation of said locking means is continued, repeated lighting operations of the operation member may be capable of being carried out.

7. A lighting device as defined in claim 5 wherein said restraining means works such that it may automatically return from the un-restraining position to the restraining position.

8. A lighting device as defined in claim 7 wherein said restraining means works such that the returning movement from the un-restraining position to the restraining position may be obstructed at an intermediate point of the returning movement, and such that, when said locking means is set from the position for the lock release to the position for the locking, said restraining means may return from the intermediate point of the returning movement to the restraining position.

9. A lighting device as defined in claim 7 wherein the lighting device is provided with a retaining means, which retains said restraining means at the un-restraining position, and a retention releasing means, which releases said restraining means from the retention by said retaining means, said releasing being carried out in association with the lighting operation of the operation member.

10. A lighting device as defined in claim 7 wherein the lighting device is provided with a retaining means, which retains said restraining means at the un-restraining position, and a retention releasing means, which releases said restraining means from the retention by said retaining means, said releasing being carried out in association with the lock releasing operation of said locking means.

11. A lighting device as defined in claim 5 wherein the lighting device is provided with:

a locking member, which interferes with a portion of the operation member and locks the lighting operation, a first resilient means, which urges said locking member toward the position for the locking, a restraining member, which works such that, when said restraining member is set at the restraining position, said restraining member may restrain a movement of said locking member toward the position for the lock release, and such that, when said restraining member is set at the un-restraining position, said restraining member may allow the movement of said locking member toward the position for the lock release, and a second resilient means, which urges said restraining member toward the restraining position, said locking member being moved to the position for the lock release against the urging force of said first resilient means after said restraining member has been moved from the restraining position to the un-restraining position.

12. A lighting device as defined in claim 5 wherein said locking means is constituted of a working member, which is capable of being operated from the exterior, and a locking member, which obstructs the operation of the operation member, said locking member being moved by said working member from the position for the locking to the position for the lock release.

13. A lighting device as defined in claim 5 wherein said restraining means works such that said restraining means may be retained at the un-restraining position by resilient force of said restraining means itself, such that said restraining means may be moved, accompanying the movement of said locking means, and may thereby be released from the retention at the un-restraining position, and such that said restraining means may return to the restraining position by the resilient force of said restraining means itself.

* * * * *